US006460711B1

(12) United States Patent
Kato et al.

(10) Patent No.: US 6,460,711 B1
(45) Date of Patent: Oct. 8, 2002

(54) SUSPENSION TYPE HOISTING APPARATUS

(75) Inventors: Kazumichi Kato; Yuushi Sato; Susumu Nakagawa; Katsumi Yasuda; Tsukasa Sugino, all of Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/285,002

(22) Filed: Apr. 1, 1999

(30) Foreign Application Priority Data

| | | |
|---|---|---|
| Apr. 1, 1998 | (JP) | 10-088743 |
| May 27, 1998 | (JP) | 10-145456 |
| Jun. 24, 1998 | (JP) | 10-176812 |

(51) Int. Cl.[7] ..... B66C 13/06
(52) U.S. Cl. ..... 212/275
(58) Field of Search ..... 212/275, 273

(56) References Cited

U.S. PATENT DOCUMENTS

| | | | | | |
|---|---|---|---|---|---|
| 5,491,549 | A | * | 2/1996 | Wichner et al. | 212/275 |
| 5,526,646 | A | * | 6/1996 | Overton | 212/275 |
| 5,642,822 | A | * | 7/1997 | Monzen et al. | 212/275 |
| 5,729,453 | A | * | 3/1998 | Lee et al. | 212/275 |
| 5,760,415 | A | * | 6/1998 | Hauck et al. | 250/559.33 |
| 5,785,191 | A | * | 7/1998 | Feddema et al. | 212/275 |
| 5,908,122 | A | * | 6/1999 | Robinett et al. | 212/275 |
| 5,960,969 | A | * | 10/1999 | Habisohn | 212/275 |
| 6,182,843 | B1 | * | 2/2001 | Tax et al. | 212/274 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A suspension type hoisting apparatus has the position of an elevating portion, which is elevatably suspended from a base via a suspension member, adjusted by a positioning member for positioning the suspension member suspended from a carriage in the horizontal plane. The suspension type hoisting apparatus also includes a position controller for outputting a velocity reference signal on the basis of a deviation between a position reference signal of the positioning member and the actual position thereof, and a velocity controller for outputting a force reference signal being a manipulated variable of the positioning member on the basis of a deviation between the velocity reference signal, of the positioning member, outputted from the position controller and the actual velocity thereof; wherein a sway velocity of the elevating portion is detected. A sway controlling signal, with respect to the positioning member, is generated on the basis thereof, and the sway controlling signal is added to the force reference signal outputted from the velocity controller. Thereby, in a case where there is sway at the elevating portion, the positioning member is equivalently displaced in proportion to a sway velocity of the elevating portion, the sway of the elevating portion is suppressed in a remarkably short time, and at the same time, the elevating portion is accurately positioned at a reference position along with attenuation of sway of the elevating portion.

11 Claims, 18 Drawing Sheets

FIG. 3A
PRIOR ART
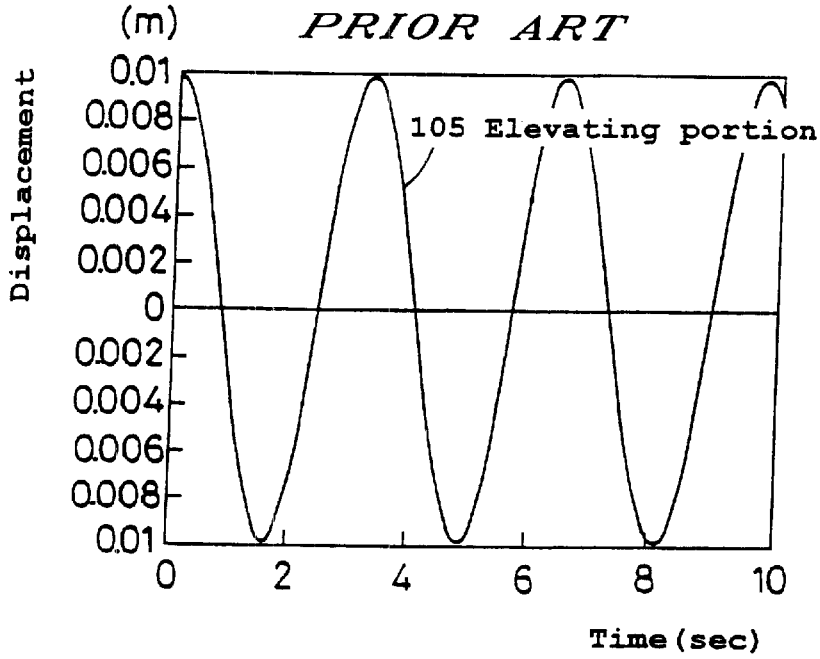
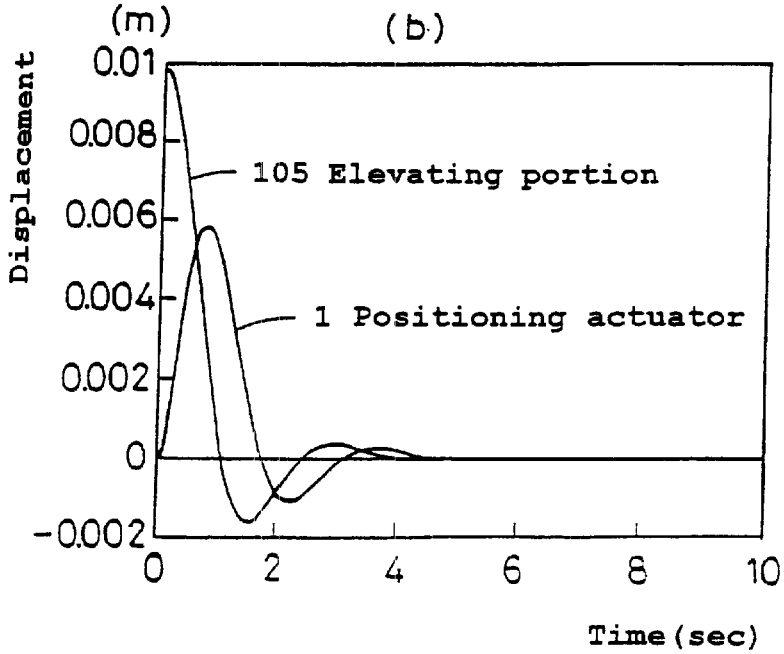
FIG. 3B
PRIOR ART

SUSPENSION TYPE HOISTING APPARATUS

BACKGROUND OF THE INVENTION

1. Field of the Invention

The present invention relates to a suspension type hoisting apparatus which has an elevating portion elevatably suspended from a base (for example, a carriage) via a suspension member and is able to suppress sway of the elevating portion in a short time.

2. Description of the Prior Art

There are many cases where a transfer apparatus, in which a suspension type hoisting apparatus (so-called crane) is incorporated, is frequently used as transfer equipment of loads in, for example, a factory. One example of such a transfer apparatus is illustrated in FIGS. 21(*a*) and 21(*b*).

The transfer apparatus AO, shown in FIGS. 21(*a*) and 21(*b*), is constructed and provided with a carriage 103 moving along a rail 102 disposed at the ceiling 101, a suspension member 104 suspended from the carriage 103, and an elevating portion 105 attached to the lower end portion of the suspension member 104. A hand 105*a* which is able to hold an appointed load 106 is integrally attached to the elevating portion 105. The suspension member 104 is wound and unwound by a winding device (not illustrated) which is attached to, for example, the carriage 103 side, whereby the elevating portion 105 is elevated and lowered.

When the load 106 is transferred by the transfer apparatus AO, first, as shown in FIG. 21(*a*), the carriage 103 is stopped right above the load 106, and the elevating portion 105 is lowered to cause the hand 105*a* to hold the load 106. And, the elevating portion 105 is elevated to an appointed position with the load 106 held, and the elevating portion 105 is fixed at the carriage 103, wherein the load 106 is transferred by the carriage 103 to a reference position along the rail 102 in a state shown in FIG. 21(*b*). When the load 106 arrives at the reference position, the carriage 103 is positioned right above a placing position of the load 106, and the load 106 is placed thereon by lowering the elevating portion 105 again.

By repeating the operations, loads can be efficiently carried or transferred, utilizing space in the vicinity of the ceiling, wherein there are comparatively few obstacles.

However, since the conventional transfer apparatus AO is constructed so that the elevating portion 105 is suspended by the suspension member 104, the elevating portion 105 constitutes a pendulum, using the carriage 103 as a fulcrum. Therefore, for example, when the elevating portion 105 is elevated or lowered, sway occurs at the elevating portion 105, which is responsive to inherent frequency determined by the length of the suspension member 104. Therefore, in the conventional transfer apparatus AO, even though the carriage 103 reaches the reference position and causes the elevating portion 105 to be lowered, a load 106 can not be held by the hand 105*a* or a held load can not be placed by the hand 105*a* until the sway of the elevating portion 105 stops, wherein transfer efficiency is adversely influenced.

Furthermore, although a passive sway controlling device (for example, movement absorbing device, damper, etc.,) has been attached as a countermeasure, it is very cumbersome to adjust the sway controlling device, for example, in a case where the stop height of the elevating portion 105 differs.

SUMMARY OF THE INVENTION

The present invention was developed in view of the above-described drawbacks, and it is an object of present invention to provide a suspension type hoisting apparatus which is able to remarkably improve working efficiency by effectively stopping sway of the elevating portion.

In order to achieve the above-stated object, the present invention provides: a suspension type hoisting apparatus, which is able to adjust the position of an elevating portion elevatably suspended from the base via the suspension member by an elevating portion position controlling device, which is constructed and provided with a means for positioning a suspension member suspended from the base in the horizontal plane; a position controller for outputting a velocity reference signal on the basis of a deviation between a position reference signal and actual position with respect to the positioning means; and a velocity controller for outputting a force reference signal being a manipulated variable of the positioning means, on the basis of a deviation between the velocity reference signal outputted from the position controller for the positioning means and actual velocity, wherein, the elevating portion position controlling device includes a sway velocity detecting means for detecting a sway velocity of the elevating portion; a sway stop compensation portion for outputting a sway controlling signal for the positioning means on the basis of output from the sway velocity detecting means; and an adder portion for adding the sway controlling signal outputted from the sway stop compensation portion to an appointed signal on the control loop of the elevating portion position controlling device. Thereby, since it is possible to effectively stop sway of the elevating portion and to carry out positioning thereof by a simple control system, remarkable improvements in working efficiency can be secured.

Herein, the force reference signal outputted from the velocity controller, the velocity reference signal inputted into the velocity controller, or a position reference signal inputted into the position controller is considered as the appointed signal on the control loop of the elevating portion position controlling device, to which the sway controlling signal is added.

Furthermore, in a case where the base is constructed of a carriage, a moving means of the carriage may be used as the positioning means. However, in this case, the positioning direction is limited to the moving direction (for example, direction of a rail) of the carriage.

Furthermore, the sway stop compensation portion may be composed of a proportional element, for example, the value of which is established in compliance with a stop height of the elevating portion.

Still furthermore, in order to prevent a servo system from oscillating due to observation noise, it is preferable that a filter for eliminating such observation noise is attached to the sway stop compensating portion.

In a case where the sway velocity detecting means is composed so as to detect the relative sway velocity of the elevating portion with respect to the base, it is preferable that the sway velocity detecting means is further provided with a elastic vibration component detecting means for detecting elastic vibration components produced at the base, and an excluding means for influences due to the elastic vibration components from sway control made by the sway stop compensation portion on the basis of the elastic vibration components detected by the elastic vibration component detecting means.

Herein, the excluding means, for example, may be constructed so that it excludes influences, resulting from the elastic vibration components, from the sway control by adding elastic vibration compensating signals generated on the basis of the elastic vibration components detected by the elastic vibration component detecting means to the sway controlling signals outputted from the sway stop compensation portion. At this time, the elastic vibration compensating signal may be generated by a elastic vibration component compensation portion including a band pass filter to exclude noise components contained in the elastic vibration components detected by the elastic vibration component detecting means and a phase compensation portion for compensating a phase between the relative sway velocity of the elevating portion and the elastic vibration components.

Furthermore, the excluding means may be composed of a notch filter for suppressing the elastic vibration components from signals corresponding to the sway velocity of the elevating portion. In this case, a frequency band suppressed by the notch filter is adjusted on the basis of the elastic vibration components detected by the elastic vibration component detecting means.

Here, the elastic vibration component detecting means may be composed so that, for example, signals corresponding to acceleration signals of the elastic vibration components can be detected.

Furthermore, the sway velocity detecting means for detecting the relative sway velocity for the base of the elevating portion is provided with, for example, a light emitting means installed on the base or the elevating portion, a lens installed on the elevating portion or the base opposite to the light emitting means, which focuses light coming from the light emitting means, a light receiving position detecting element installed on the elevating portion or the base and used to detect the light receiving position by receiving light focused by the lens, wherein the sway velocity detecting means detects relative positions of the elevating portion with respect to the base one after another on the basis of the light receiving position detected by the light receiving position detecting element, and at the same time detects relative velocitys of the elevating portion on the basis of the detected relative position of the elevating portion.

Furthermore, if the sway velocity detecting means is further provided with at least two light emitting means and a calculating means is provided, which calculates a position of the elevating portion in the horizontal direction, a position of the elevating portion in the perpendicular direction and a rotating angle around the perpendicular axis with respect to the base on the basis of the detection results of the light receiving position detecting element with respect to the respective light by alternate blinking of the respective light emitting means, accurate and high velocity position detection is enabled by a simple construction without any image processing, etc.

Furthermore, if the plurality of light emitting means are provided in a plurality of sets with the installation interval of these light emitting means changed, and one set of the plurality of sets of light emitting means is selectively used in compliance with an elevation length of the elevating portion, the range of detection can be prevented from being decreased as much as possible if the distance between the base and the elevation port is close to each other, and detection accuracy can be prevented from being lowered in a case where the distance between the base and the elevating portion is far.

Furthermore, if a lighting state detecting means is provided, which detects the lighting state of the light emitting means on the basis of a quantity of light received by the light receiving position detecting element, and the detection results of the light receiving position detecting element are acquired by, the calculating means on the basis of the lighting state of the light emitting means, which is detected by the lighting state detecting means, it is not necessary to provide any electric wiring between the base and the elevating portion, and even though the light emission timing of the light emitting means is changed, it is not necessary that the acquisition timing of the light receiving position is changed in line therewith.

Furthermore, it is assumed that the sway velocity detecting means is further provided with a memory element for temporarily holding the light receiving position detected by the light receiving position detecting element, the memory element is renewed on the basis of the lighting state of the light emitting means, which is detected by the lighting state detecting means, and the calculating means carries out the calculation at every appointed interval of time on the basis of the light receiving position temporarily held in the memory element, wherein, the calculating means is able to acquire the light receiving position from the memory element at an interval matched up to a light emitting timing of the light emitting means without providing connection wiring between the base and the elevating portion.

Furthermore, a variable stop means for varying the quantity of light incident into the light receiving position detecting element and a stop controlling portion for controlling the variable stop means in compliance with an elevation length of the elevating portion are provided, wherein, for example, by controlling the opening diameter of the variable stop means so as to decrease in line with an increase in height of the position of the elevating portion, it is possible to prevent a light spot from broadening on the light receiving position detecting element even though the distance between the elevating portion and the base is decreased, and it is possible to prevent the range of detection from being decreased. Still furthermore, in addition thereto, fluctuation, in a short or long distance, of the light receiving quantity of the light receiving position detecting element can be decreased, wherein the position detecting accuracy thereof can be improved.

BRIEF DESCRIPTION OF THE DRAWINGS

FIG. 3(*a*) is a transient response time chart for the conventional transfer apparatus AO as to the displacement of the elevating portion 105 to when an initial deviation from a neutral position is given, and FIG. 3(*b*) is a transient response time chart for the transfer apparatus A1 as to the displacement of the elevating portion 105 to when an initial deviation from a neutral position is given;

DETAILED DESCRIPTION OF THE PREFERRED EMBODIMENTS

Hereinafter, a description is given of preferred embodiments with reference to the accompanying drawings in order to better understand the present invention. The following preferred embodiments are only examples in which the present invention is embodied. The following preferred embodiments are not intended to limit the scope of the present invention.

Figure 1:
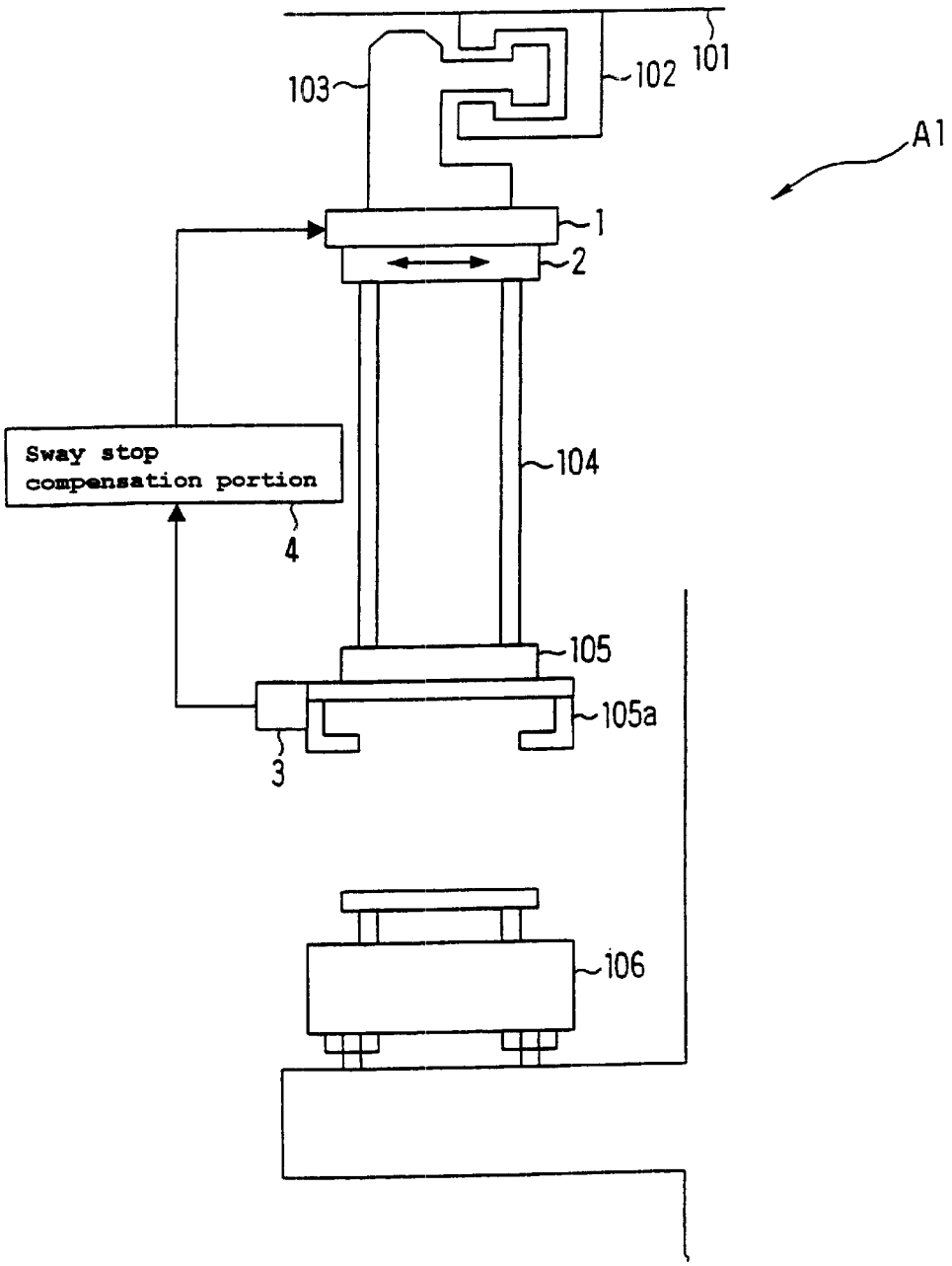
FIG. 1 is an exemplary view showing a simple construction of a transfer apparatus A1 according to a preferred embodiment of the present invention.
Figure 21A:
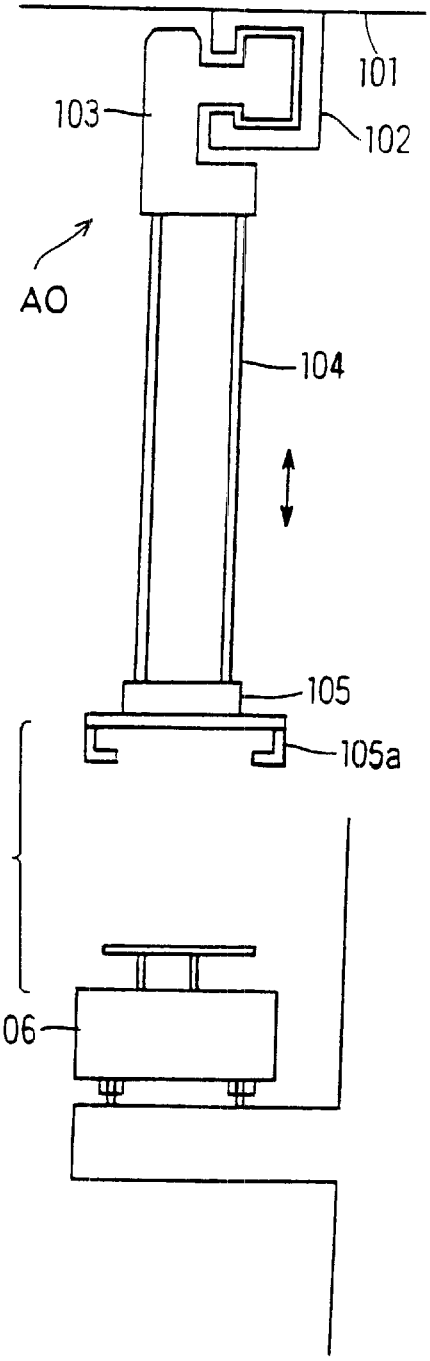
FIG. 21A PRIOR ART
FIGS. 21(*a*) and 21(*b*) are exemplary views showing a simple construction of a transfer apparatus AO according to the prior art.
Figure 21B:
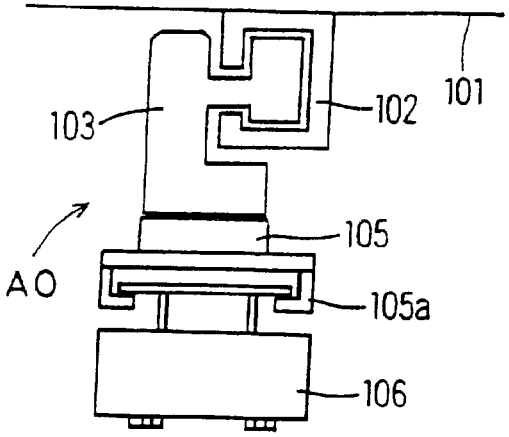
FIG. 21B PRIOR ART

A transfer apparatus A1, according to the preferred embodiment as shown in FIG. 1, is one example in which a suspension type hoisting apparatus, according to the present invention, is embodied in a manner similar to the conventional transfer apparatus AO as shown in FIGS. 21(*a*) and 21(*b*), wherein elements which are common to those of the transfer apparatus AO are given the same reference numbers as those of the apparatus AO for purposes of description.

Figure 2:
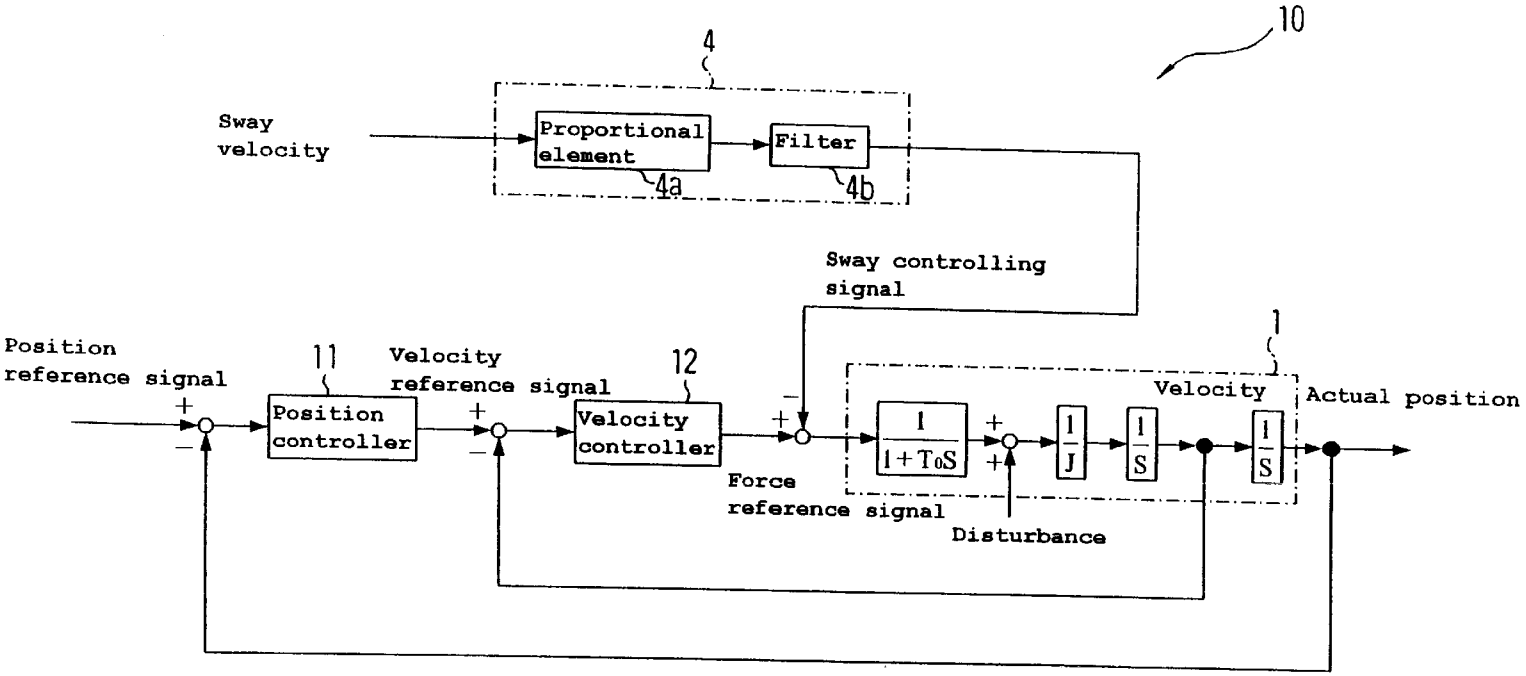
FIG. 2 is a block diagram showing a simple construction of an elevating portion position controlling apparatus 10 according to the transfer apparatus A1.

Referring to FIG. 1, the transfer apparatus A1 comprises: a carriage 103 moving along a rail 102 disposed on a ceiling 101; a positioning actuator 1 (one example of a positioning means) having its bottom surface attached to an upper surface of an upper plate 2, wherein the positioning actuator 1 and the upper plate 2 are attached to the underside of the carriage 103; a suspension member 104 suspended from the upper plate 2; an elevating portion 105 attached to the lower end portion of the suspension member 104; a hand 105*a* capable of holding a load 106, which is integrally attached to the bottom of the elevating portion 105; a sway velocity sensor 3 (one example of a sway velocity detecting means) attached to the side of the hand 105*a* attached to the elevating portion 105, wherein the sway velocity sensor 3 detects the sway velocity (absolute velocity) of the elevating portion 105; and an elevating portion position controlling apparatus 10 (as shown in FIG. 2, the details of which will be described in more detail below) which positions the positioning actuator 1 and carries out sway control of the elevating portion 105 by controlling movements of the positioning actuator 1.

The suspension member 104 is wound and unwound by, for example, a winding device (not illustrated) attached to the upper plate 2 side, whereby the elevating portion 105 is elevated and lowered.

The positioning actuator 1 relatively moves the upper plate 2 in the horizontal direction orthogonal to the rail 102 with respect to the carriage 103, and it is operated by a force reference signal coming from the elevating portion position controlling apparatus 10. Furthermore, the actual position (actual movement amount) and actual velocity of the positioning actuator 1 are detected by a sensor (not illustrated).

Subsequently, a description is given of the construction and control actions of the elevating portion position controlling apparatus 10, using a control block diagram shown in FIG. 2.

The elevating portion position controlling apparatus 10 comprises, as shown in FIG. 2, a position controlling loop for outputting a velocity reference signal by a position controller 11 on the basis of a deviation between the position reference signal and actual position for the positioning actuator 1; a velocity controlling loop for outputting a force reference signal to the positioning actuator 1 by the velocity controller 12 on the basis of a deviation between the velocity reference signal and actual velocity for the positioning actuator 1, which are outputted by the position controller 11; and a sway stop compensation portion 4 which outputs a sway controlling signal for the positioning actuator 1 on the basis of the sway velocity of the elevating portion 105, outputted from the sway velocity sensor 3, and adds the sway controlling signal to the force reference signal outputted from the velocity controller 12 after the sway controlling signal is phase-reversed.

The sway stop compensating portion 4 is composed of a proportional element 4*a* and a filter 4*b*. The proportional element 4*a* is established in accordance with an elevation length of the elevating portion 105. Furthermore, the filter 4*b* is a low-pass filter secured in order to prevent a servo system from oscillating due to the observation noise by eliminating the observation noise.

Subsequently, a description is given of the control actions of the positioning actuator 1 by the elevating portion position controlling apparatus 10.

As the carriage 103 stops at a reference position, a position reference signal is given to the elevating portion position controlling apparatus 10 so that the positioning actuator 1 is controlled so as to stop at an appointed reference point (which is determined by the relative position between the carriage 103 and the upper plate 2). The position reference signal is inputted into the position controller 11 after a deviation (positional deviation) from the actual position of the positioning actuator 1 is obtained. A velocity reference signal. by which the position deviation is made zero, is outputted from the position controller 11, and furthermore, the velocity reference signal is inputted into the velocity controller 12 in a state where a deviation (velocity deviation) from the actual velocity of the positioning actuator 1 is obtained. A force reference signal, by which the velocity deviation is made zero, is outputted from the velocity controller 12.

Furthermore, at the same time, a sway velocity of the elevating portion 105, which is outputted from the sway velocity sensor 3 is outputted, and is inputted into the sway stop compensating portion 4. Thrust which is responsive to the sway velocity of the elevating portion 105 is outputted in the sway stop compensating portion 4 by the proportional element 4*a* and is further outputted via the filter 4*b* as a sway controlling signal.

The sway controlling signal outputted from the sway stop compensating portion 4 is added to the force reference signal outputted from the velocity controller 12 after being phase-reversed, and the corresponding force reference signal is inputted into the positioning actuator 1, wherein a desired action is carried out.

By the control, if sway occurs at the elevating portion 105, the positioning actuator 1 is equivalently displaced in proportion to the sway velocity of the elevating portion 105 in a case where the sway frequency is sufficiently lower than the velocity control frequency. Herein, since, if a position deviation between the upper plate 2 and the elevating portion 105 is produced, a force proportional thereto operates onto the elevating portion 105, a force which is proportional to the sway velocity of the elevating portion 105 is given to the elevating portion itself as an attenuation force, wherein the sway of the elevating portion 105 is suppressed in a short time. Furthermore, since the sway control signal outputted from the sway stop compensating portion 4 is added to the force reference signal outputted from the velocity controller 12 in the form of disturbance, the positioning actuator 1 is accurately positioned at a reference position along with attenuation of sway of the elevating portion 105 by the position control loop.

FIGS. 3(*a*) and 3(*b*) show transient response time charts as to the displacement of the elevating portion 105 to when an initial deviation from a neutral position is given. FIG. 3(*a*) shows a transient response time chart for the conventional transfer apparatus AO as shown in FIGS. 21(*a*) and 21(*b*), and FIG. 3(*b*) shows a transient response time chart for the transfer apparatus A1 according to the present invention as shown in FIG. 1. Although, in the conventional transfer apparatus AO as shown in FIGS. 21(*a*) and 21(*b*), almost no attenuation occurs in a short time, the positioning actuator 1 is displaced in proportion to the sway velocity of the elevating portion 105 in the transfer apparatus A1 as shown in FIG. 1. Resultantly, the sway of the elevating portion 105 is absorbed in a remarkably short time. Furthermore, it is easily understood in FIG. 3(*b*) that, in the transfer apparatus A1 as shown in FIG. 1, the positioning actuator 1 is accurately positioned at a reference position along with attenuation of the sway of the elevating portion 105.

As described above, in the transfer apparatus A1 according to the preferred embodiment as shown in FIG. 1, if sway occurs at the elevating portion 105, the positioning actuator 1 is equivalently displaced in proportion to the sway velocity of the elevating portion 105, and a force, which is in proportion to a position deviation between the upper plate 2, and the elevating portion 105, which is produced in line with the displacement, is given to the elevating portion 105 as an attenuation force. Therefore, the sway of the elevating portion 105 is suppressed in a short time. Furthermore, the sway controlling signal outputted from the sway stop compensation portion 4 is added to a force reference signal outputted from the velocity controller 12 in the shape of disturbance. Therefore, the positioning actuator 1 is accurately positioned at a reference position along with attenuation of sway of the elevating portion 105 by the position controlling loop. As described above, it is possible to effectively stop sway of the elevating portion and to carry out positioning thereof by a simple control system, wherein working efficiency is remarkably improved.

Other Modified Examples of the Sway Velocity Detecting Means

The sway velocity sensor 3 is not limited to only a type in which the absolute velocity of the elevating portion 105 is directly detected. For example, it is a matter of course that the sway velocity sensor 3 may be such types in which the output of an acceleration sensor is integrated, or the output of the position sensor is differentiated. Furthermore, the sway velocity sensor 3 may be composed so that the relative sway velocity of the elevating portion 105 to the upper plate 2 is detected. A typical example of detecting the relative sway velocity is a method of detecting the relative position of the elevating portion 105 relative to the upper plate 2 and differentiating the output thereof.

Figure 10:
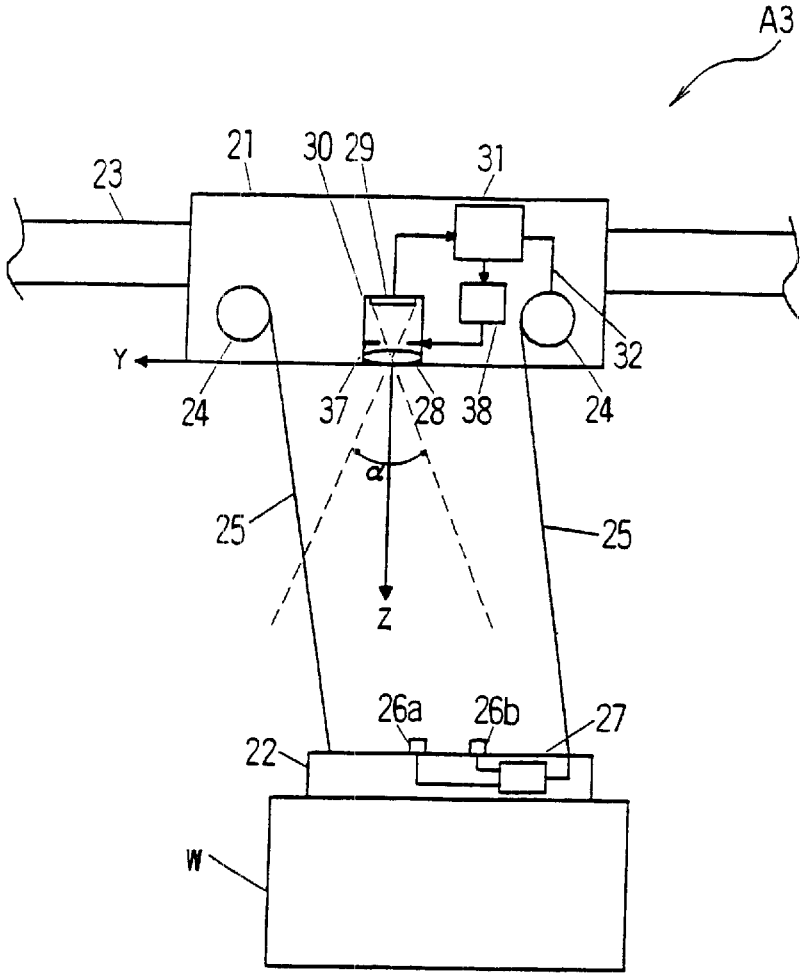
FIG. 10 is an exemplary view showing a simple construction of a transfer apparatus A3 according to a second modified embodiment.

Thus, a description is given of one example of transfer apparatuses incorporating an elevating portion position detecting apparatus, which detects the relative sway velocity on the basis of the relative position of the elevating portion. Furthermore, in the transfer apparatus A2, as shown in FIG. 4, and transfer apparatuses A3 and A4, as shown in FIGS. 10 and 4, respectively, according to the modified examples to be described in more detail below, the description of the parts pertaining to the sway stop control based upon the output of the elevating portion position detecting device is omitted.

Figure 4:
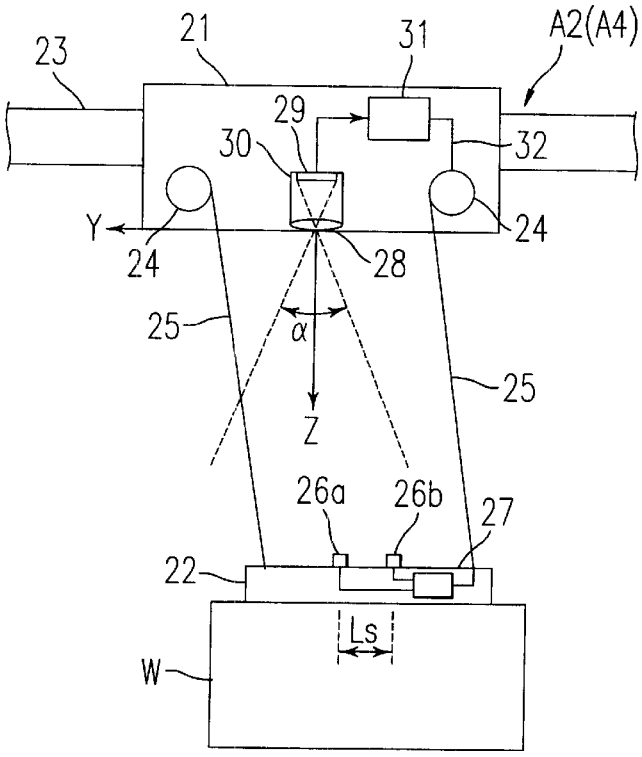
FIG. 4 is an exemplary view showing a simple construction of transfer apparatuses A2 and A4 according to the preferred embodiments of the invention.

As shown in FIG. 4, the transfer apparatus A2 comprises: a carriage 21 (one example of the base) moving along a rail 23 arranged in the vicinity of the ceiling; a suspension member 25 suspended from the carriage 21; and an elevating portion 22, which is attached to the lower end of the suspension member 25 and which is able to hold a load W. The elevating portion 22 is elevated and lowered by winding or unwinding operations of the suspension member 25 by a winding drum 24 attached to the carriage 21.

The elevating portion 22 is provided with two light emitting diodes (hereinafter called "LEDs") 26*a* and 26*b* (one example of light emitting means), and a light emission control portion 27 which controls light emission of the LEDs 26*a* and 26*b*.

Furthermore, the carriage 21 is provided with a light receiving device 30 consisting of a lens 28 for condensing light emitted from the LEDs 26*a* and 26*b*, and a semiconductor position detecting sensor or element 29 (one example of the light receiving position detecting means) which detects the light receiving position (center position of light spot) by receiving light focused by the lens 28. Furthermore, the carriage 21 is provided with a calculating portion 31 which calculates a position in the horizontal direction, a position in the perpendicular direction, and a rotating angle around the perpendicular axis of the elevating portion 22 with respect to the carriage 21 on the basis of the light receiving position detected by the position detecting sensor 29, while attempting to synchronize the light emission timing of the LEDs 26*a* and 26*b* controlled by the light emission controlling portion 27 and the timing of acquiring a light receiving position signal by the position detecting sensor 29.

Subsequently, using FIG. 5, a detailed construction of the calculating portion 31 and control procedures centering around the calculating portion 31 are described.

Figure 5:
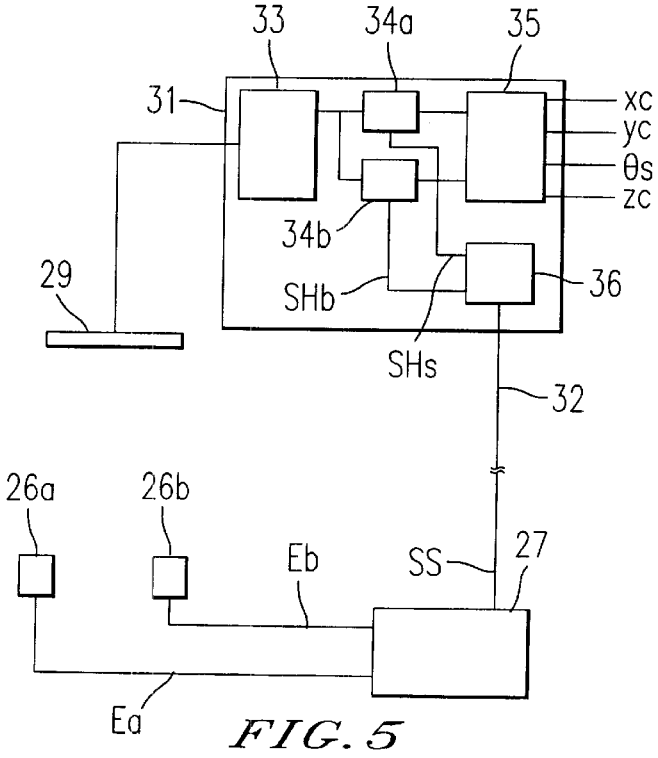
FIG. 5 is a block diagram showing a simple construction of a calculating portion 31 and its related portions of the transfer apparatus A2.

As shown in FIG. 5, the calculating portion 31 is composed of a light spot position calculating portion 33, memory elements 34*a* and 34*b*, a position posture calculating portion 35, and a timing signal generation portion 36.

In the light spot position calculating portion 33, coordinate values of the light spot on the position detecting sensor 29 are calculated and outputted on the basis of the output signal of the position detecting sensor 29. The coordinate value data outputted from the light spot position calculating portion 33, which correspond to light coming from the LED 26*a* are stored in a memory element 34*a*, and those which correspond to light coming from the LED 26*b* are stored in a memory element 34*b*.

The timing signal generation portion 36 periodically outputs a START signal to the light emission controlling portion 27, and at the same time outputs a data HOLD signal (i.e., either SHa or SHb) to the memory elements 34*a* and 34*b*, respectively. These procedures are described, using a timing chart shown in FIG. 6. As a START signal SS is outputted from the timing signal generation portion 36 to the light emission controlling portion 27, lighting signals Ea and Eb, which cause the LEDs 26*a* and 26*b*, respectively, to be turned on, are alternately outputted from the light emission controlling portion 27 with a time slide. On the basis thereof, the LEDs 26*a* and 26*b* blink one after the other. At this time, the timing signal generation portion 36 sends out a HOLD signal SHa, which renews the HOLD data, to the memory element 34*a* while the LED 26*a* is lit, and sends out a HOLD signal SHb, which renews the HOLD data, to the memory element 34*b* while the LED 26*b* is lit. Thereby, the coordinate value data of light spot position on the position detecting sensor 29 pertaining to each of the LEDs 26*a* and 26*b* are held in the memory elements 34*a* and 34*b* one after another. The coordinate value data stored[, respectively,] in the memory elements 34*a* and 34*b* are used as coordinate value data of light spot position pertaining to each of the LEDs 26*a* and 26*b*, respectively, at the same time. Actually, there is a difference Δt between the light emission times of the LEDs 26*a* and 26*b*. However, if the light emission interval Δt of the LEDs 26*a* and 26*b* is set to a sufficiently high velocity (for example, several KHz or more) to the cycle of sways of the elevating portion 22, the time difference Δt can be neglected.

Thus, by slightly sliding the blinking time of the two LEDs and storing the coordinate value data on the position detecting sensor 29 pertaining to the respective LEDs, it is not necessary to provide the position detecting sensor and lenses of the same quantity as that of the LEDs, and the system construction can be simplified. As a matter of course, a lens 28 and a position detecting sensor 29 may be provided for each of the LEDs 26*a* and 26*b*.

In the position posture calculating portion 35, a position in the horizontal direction, a position in the perpendicular direction and a rotating angle around the perpendicular axis with respect to the carriage 21 of the elevating portion 22 are calculated on the basis of the coordinate value data of light spot position on the position detecting sensor 29 pertaining to the LEDs 26*a* and 26*b*, which are stored in each of the memory elements 34*a* and 34*b*. A description is given of the calculating method, using FIG. 7.

Figure 7:
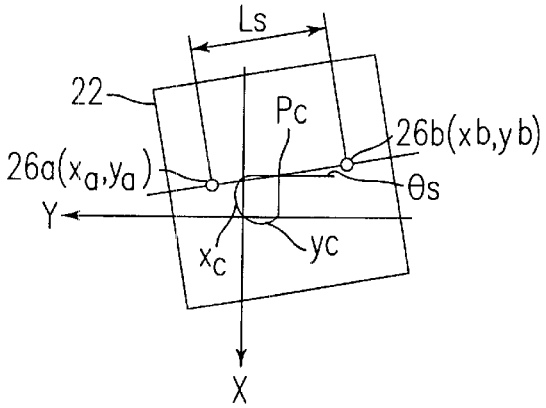
FIG. 7 is an explanatory view of position postures of the elevating portion 22.

FIG. 7 is a view observed from upside of the elevating portion 22. As a coordinate system to be used, the reference point is established at the position corresponding to the center of the light receiving device 30 on the carriage 21, wherein an X axis and a Y axis are established on the horizontal plane while a Z axis is set in the perpendicular direction (see FIG. 4 and FIG. 7). Since the sway width of the elevating portion 22 is small in the transfer apparatus A2 as shown in FIG. 4, it can be regarded that the elevating portion sways in parallel on the horizontal plane. Therefore, in the position posture calculating portion 35, deviations xc and yc in the horizontal plane, skew angle θs and a distance zc between the carriage 21 and the elevating portion 22 are calculated by the following expression.

$$m = \frac{Ls}{\sqrt{(x_a - x_b)^2 + (y_a - y_b)^2}}$$

$$xc = \frac{x_a + x_b}{2} m$$

$$yc = \frac{y_a + y_b}{2} m$$

$$zc = f_e m$$

$$\theta s = \tan^{-1}\left(\frac{x_a - x_b}{y_a - y_b}\right)$$

where (Xa, Ya) and (Xb, Yb) are, respectively, coordinate values of light focusing spots of the LEDs 26*a* and 26*b*, Ls is an installation distance between the LEDs 26*a* and 26*b*, and fe is a distance between the lens 28 and the position detecting sensor 29.

Thus, by detecting a deviation quantity for the carriage 21 at two different positions on the elevating portion 22, it is possible to easily detect not only the position of the elevating portion 22 in the horizontal direction but also the skew angle thereof. Furthermore, as regards the position of the elevating portion 22 in the perpendicular direction, it is possible to detect the position thereof at higher accuracy than that in the case of using the pay-out amount of the winding drum 24 which is influenced by mechanical errors.

Furthermore, since in the transfer apparatus. A2, the positions of the LEDs 26*a* and 26*b* are detected by using the PSD 29, an image process is no longer required, and it is possible to detect the positions thereof at a high velocity and high accuracy by a small-sized simple construction, whereby production cost is reduced.

Furthermore, two LEDs 26*a* and 26*b* are used in the example, it is needless to say that three or more LEDs may be used.

First Modified Embodiment of the Transfer Apparatus A2

In the transfer apparatus A2, since, as shown in FIG. 4, the range of detection of the position detecting sensor 29 is determined by a visual field angle α, the range of detection is narrowed when the elevating portion 22 is close to the carriage 21. Therefore, in order to widen the range of detection as much as possible even though the elevating portion 22 is close to the carriage 21, it is preferable that the installation interval Ls of the LEDs 26*a* and 26*b* is made small so that the LEDs 26*a* and 26*b* are easily accommodated in the visual field angle α even though the sway quantity of the elevating portion 22 is increased. However, as the Ls is decreased, the position detecting accuracy is worsened when the elevating portion 22 is apart from the carriage 21. Therefore, as shown in FIG. 8, a plurality of sets of two LEDs each having different installation intervals are installed, and, for example, sets of the LEDs are changed and used in accordance with the distance between the elevating portion 22 and the carriage 21, wherein such a problem can be solved.

Figure 8:
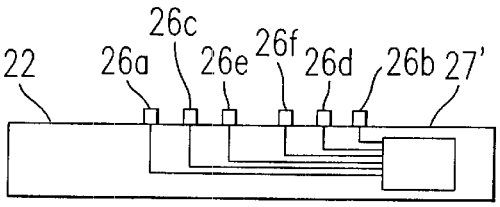
FIG. 8 is an exemplary view showing a simple construction on the elevating portion 22 according to a first modified embodiment.

In the example shown in FIG. 8, six LEDs 26*a* through 26*f* are installed on the elevating portion 22. The six LEDs constitute three sets, respectively, consisting of 26*a* and 26*b*, 26*c* and 26*d* or 26*e* and 26*f*. The LED installation intervals of each of the sets are different from each other, wherein the interval between 26*a* and 26*b* is widest and the interval between 26e and 26*f* is most narrow. At the light emission control portion 27' connected to all the LEDs, an LED set to be used is changed according to the distance zc between the carriage 21 and elevating portion 22, that is, 26*a* and 26*b* when $z2 \leqq zc$, 26*c* and 26*d* when $z1 \leqq zc \leqq z2$, and 26*e* and 26*f* when $zc < z1$ (however, $z1 < z2$). Thereby, it is possible to suppress a reduction in the range of detection as much as possible where the distance between the carriage 21 and elevating portion 22 is close, and at the same time it is possible to suppress a lowering of the detection accuracy where the distance between the carriage 21 and elevation 22 is far from each other.

Furthermore, the value of the distance zc does not become accurate until the final result of detection is calculated. That is, no accurate value is obtained at the point in time when the LED sets are changed. Therefore, it is considered that, for example, a value set when teaching is carried out in advance with respect to elevation of the elevating portion 22 is used as the distance zc. Or a rough value of the distance zc is calculated by using the LEDs 26*e* and 26*f* at the point in time when detecting the position of the elevating portion 22, and an original position process may be carried out, using the best suitable LED set by using the rough value. Furthermore, a rotary encoder is attached to the winding drum 24, whereby an original position detection process may be carried out after the LED sets are changed on the basis of a pay-out amount of the suspension member 25.

Second Modified Embodiment of the Transfer Apparatus A2

Figure 9A:
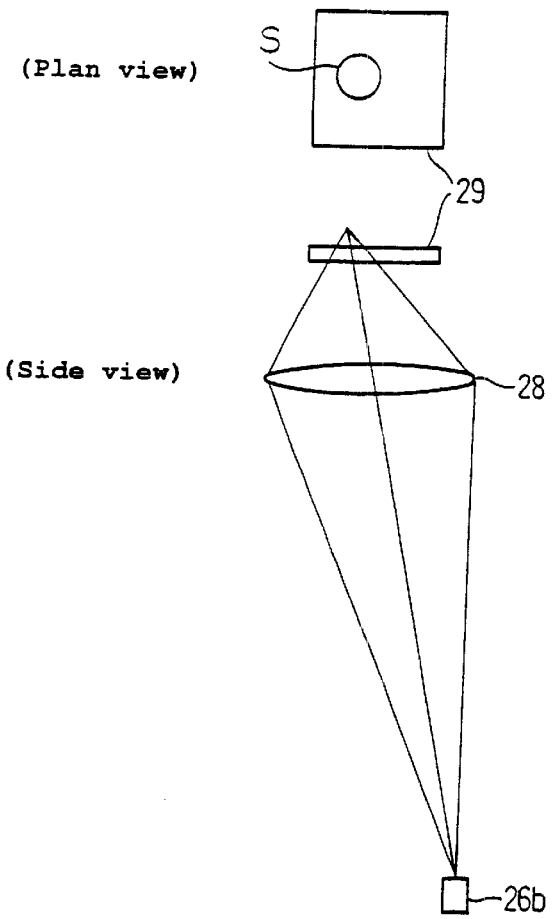
FIGS. 9(*a*) and 9(*b*) are explanatory views showing one example of a relationship between a change in the distance from the elevating portion 22 to the carriage 21 and a light spot on a position detecting sensor 29.
Figure 9B:
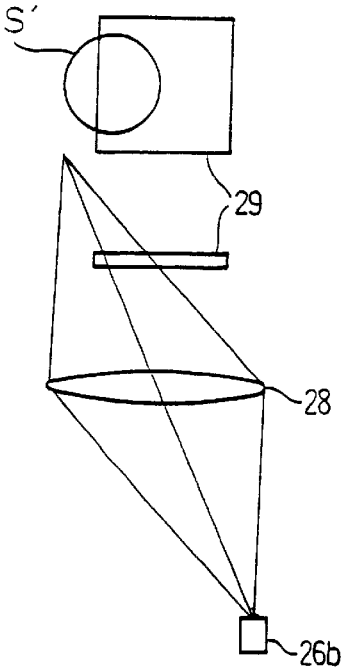

In the transfer apparatus A2, the position (image-forming position) in the optical axis direction in which light emitted from the LEDs 26*a* and 26*b* is focused as small as possible by a lens 28 may change by the distance between the LEDs 26*a*; 26*b* and the lens 28. Therefore, the size of light spot S focused on the position detecting sensor 29 may change according to the distance between the elevating portion 22 and carriage 21 (see FIGS. 9(*a*) and 9(*b*)). In the position detecting sensor which is used as one example of the light receiving position detecting element in the transfer apparatus A2 (as shown in FIG. 4), since the center position of the light spot can be detected, it is possible to detect the position even though the size of the light spot changes. However, if a part of the light spot S' comes out of the position detecting sensor 29 as shown in FIG. 9(*b*), no accurate position detection can be performed. Thus, the size of the light spot becomes an important factor to limit the range of position detection along with a reduction in the range of detection resulting from the visual field angle described in the first modified embodiment.

Therefore, a transfer apparatus A3 is presented in FIG. 10 as one example of a means for solving such a problem by which the range of detection is reduced by changes in the size of the light spot.

The transfer apparatus A3 shown in FIG. 10 provides a variable stop 37 in the vicinity of a lens 28 in the transfer apparatus A2, and furthermore provides a stop controlling portion 38 to control the opening diameter of the variable stop 37 according to a distance between the elevating portion 22 and carriage 21.

Figure 11A:
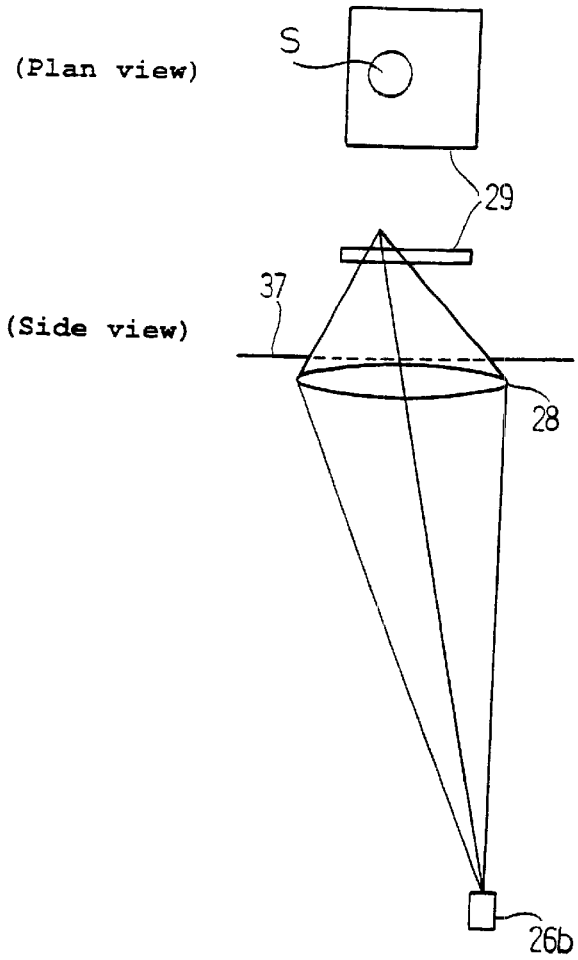
FIGS. 11(*a*) and 11(*b*) are explanatory views showing one example of a relationship between a change in the distance from the elevating portion 22 to the carriage 21 in the transfer apparatus A3, an opening diameter of the variable stop 37, and a light spot on the position detecting sensor 29.
Figure 11B:
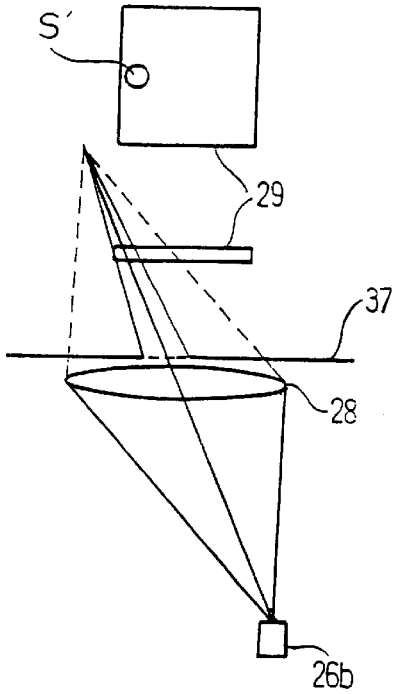

For example, as shown in FIGS. 11(*a*) and 11(*b*), the stop controlling portion 38 controls the variable stop 37 so that it increases the opening diameter of the variable stop 37 in a case where the distance between the elevating portion 22 and carriage 21 is great (FIG. 11(*a*)), and it decreases the opening diameter of the variable stop 37 in line with a reduction in the distance between the elevating portion 22 and carriage 21 (FIG. 11(*b*)). Thereby, it is possible to prevent the light spot on the position detecting sensor 29 from being enlarged even though the distance between the elevating portion 22 and carriage 21 is decreased, and it is also possible to prevent the range of detection from being reduced.

Furthermore, in addition thereto, fluctuations of the light receiving quantity depending upon the distance therebetween can be decreased, wherein such an effect can be obtained, by which the position detecting accuracy is improved. In the case of the example, the light receiving quantity of the position detecting sensor 29 is inversely proportional to almost square of the distance between the elevating portion 22 and carriage 21 and is proportional to a square of the opening diameter of the variable stop 37. Therefore, if the opening diameter of the variable stop 37 is controlled so as to be proportional to the distance between the elevating portion 22 and carriage 21, the light receiving quantity of the position detecting sensor 29 can be made almost constant.

Third Modified Embodiment of the Transfer Apparatus A2 And A3

Figure 6:
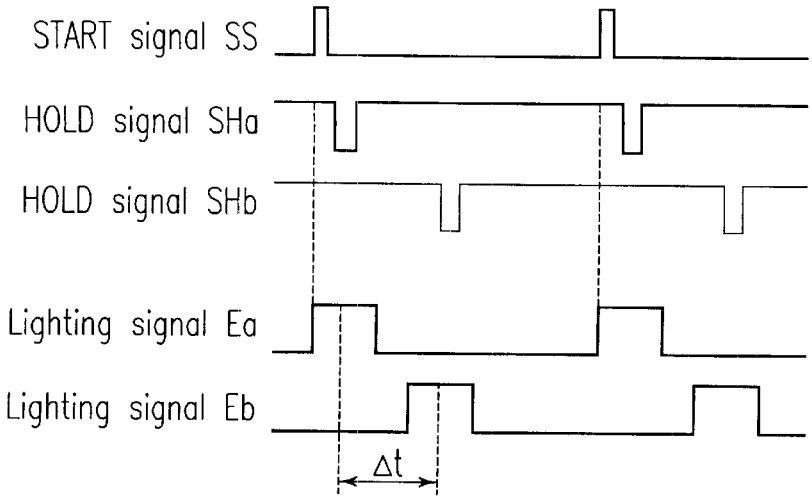
FIG. 6 is a timing chart showing the movement of START signals SS and HOLD signals SHa and SHb, which are issued from a timing signal generation portion 36, and lighting signals Ea and Eb which are issued from a light emitting portion 27.

In the transfer apparatuses A2 (as shown in FIG. 4) and A3 (as shown in FIG. 10), in order to attempt to achieve synchronization between the light emission timing of the LEDs 26*a* and 26*b* and the data renewal timing of the memory elements 34*a* and 34*b*, the START signal is transmitted to both apparatuses. However, in this case, as shown in FIG. 5, it was necessary to wire a START signal line 32 between the carriage 21 and elevating portion 22. Furthermore, as shown in FIG. 6, since the HOLD signals SHa and SHb are generated at a timing with a appointed duration of time slipped from the START signal, it was necessary to change the generation timing of the HOLD signals SHa and SHb at the same time when attempting to change the light emission timing of the LEDs 26*a* and 26*b*.

Therefore, by attempting to synchronize the light emission timing of the LEDs 26*a* and 26*b*, for example, on the basis of the lighting state of the LEDs 26*a* and 26*b* instead of using the START signal, no wiring is needed, and furthermore, it is possible to easily change the timing of data renewal of the memory elements 34*a* and 34*b* along with a change of the light emission timing.

A transfer apparatus A4, according to the third modified embodiment as shown in FIG. 4, is an overhead traveling type transfer apparatus provided with a carriage 21 (one example of the base) moving along a rail 23 disposed, for example, in the vicinity of the ceiling; a suspension member 25 suspended from the carriage 21, and an elevating portion 22 which is attached to the lower end portion of the suspension member 25 and is able to hold a load W such as a wafer cassette, etc., as in the transfer apparatus A2 (see FIG. 4).

Figure 12A:
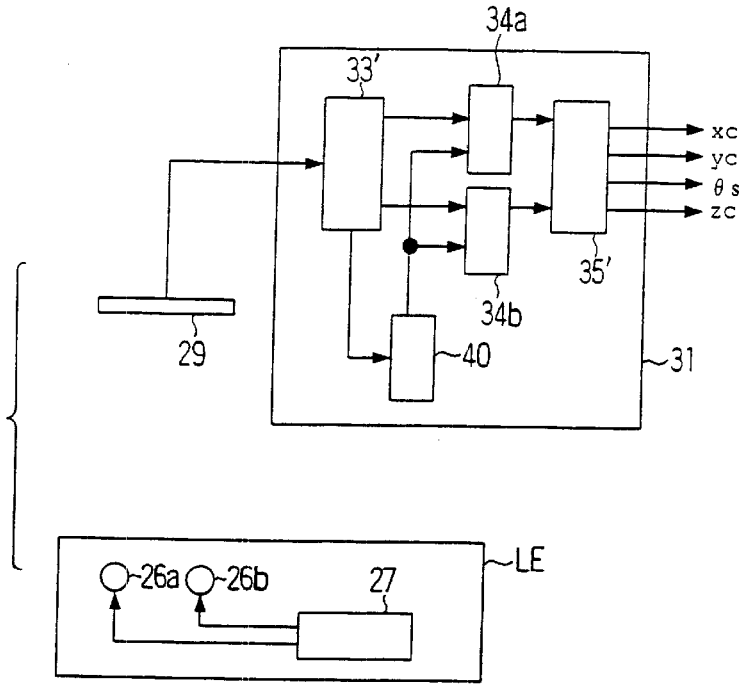
FIGS. 12(*a*) and 12(*b*) are block diagrams showing a simple construction of major parts of a transfer apparatus 4 according to a third modified embodiment.
Figure 12B:
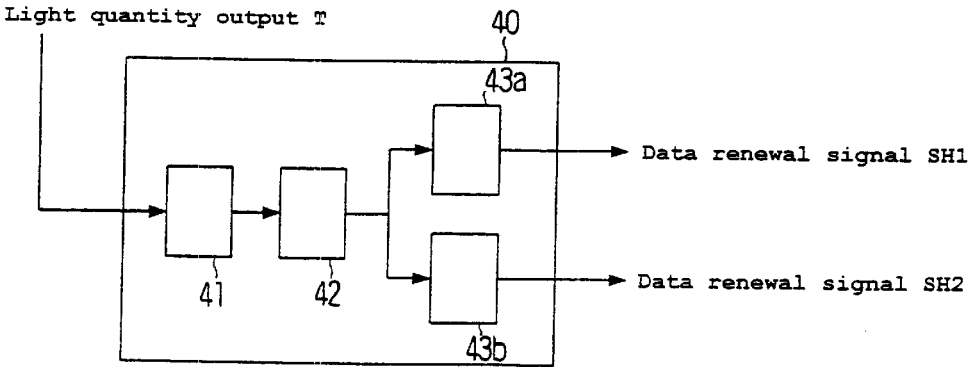

As shown in FIGS. 12(*a*) and 12(*b*), the transfer apparatus A4, as shown in FIG. 4, is different from the transfer apparatus A2, as also shown in FIG. 4, in that the calculating portion 31 is provided with a data renewal generating portion 40 consisting of a comparator element 41 (one example of the lighting state detecting means) to detect the lighting state of the LEDs 26*a* and 26*b* on the basis of the quantity of light received by the position detecting sensor 29 and generation circuits 42, 43*a* and 43*b* to generate data renewal signals in order to renew the HOLD content of the memory elements 34*a* and 34*b* on the basis of the lighting state of the LEDs 26*a* and 26*b* detected by the comparator element 41, and the same is provided with a position posture calculating portion 35' which calculates the position in the horizontal direction and rotating angle around the perpendicular axis, at each appointed interval of time, on the basis of the light receiving position which is temporarily held in the memory elements 34*a* and 34*b* driven by data renewal signals coming from the data renewal signal generating portion 40.

Figure 13:
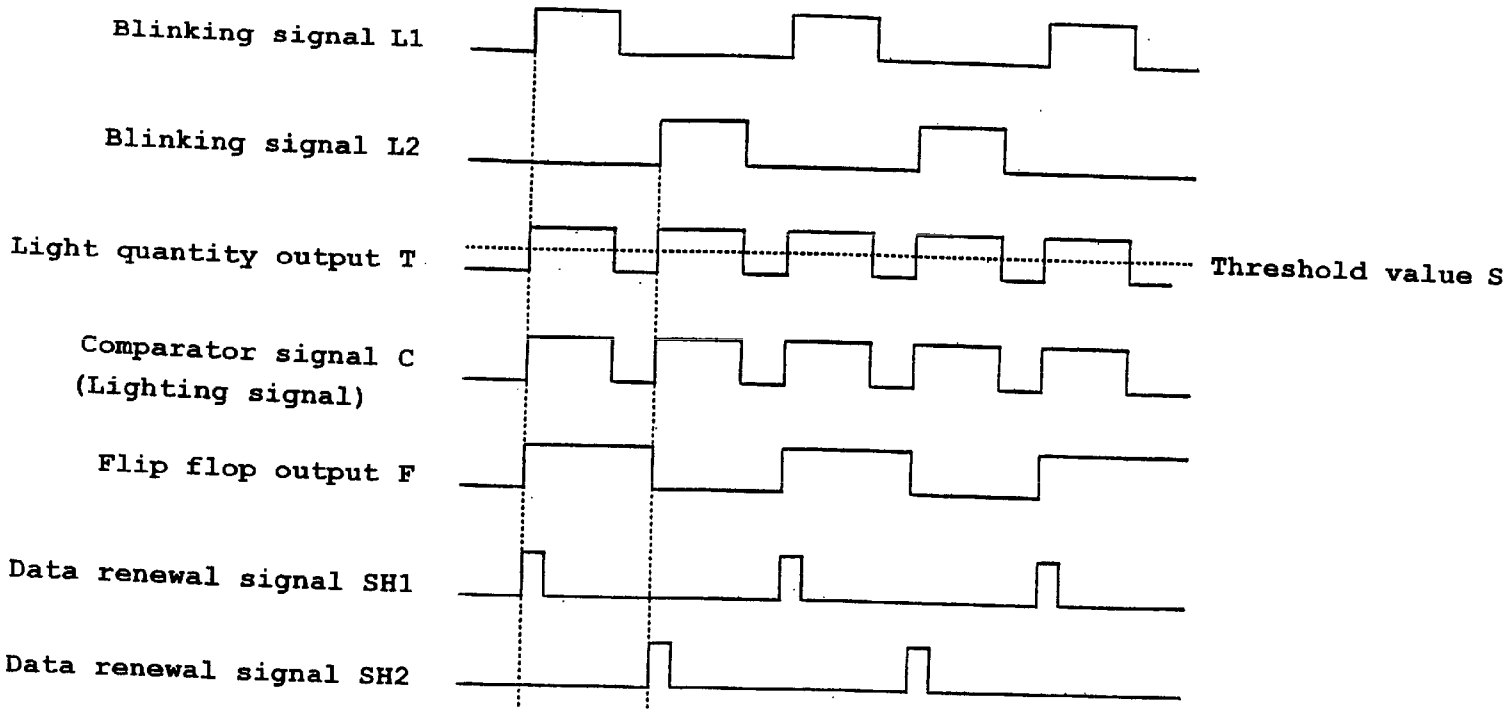
FIG. 13 is a timing chart to explain position detecting movement in the transfer apparatus A4.

Hereinafter, with references to FIGS. 12(*a*) and 12(*b*) and FIG. 13, a detailed description is given of the transfer apparatus A4 as shown in FIG. 4. Herein, FIG. 13 is a timing chart showing, in time series, actions of the light emission controlling portion 27, comparator element 41, generating circuits 42, 43*a* and 43*b*. Furthermore, a description of the construction which is common to that of the transfer apparatus A2, as shown in FIG. 4, is as described above. Therefore, it is omitted unless otherwise necessary.

In the transfer apparatus A4 as shown in FIG. 4, a light emission controlling portion 27 of the light emitting means LE side supplies, as shown in FIG. 13, blinking signals L1 and L2 to the LEDs 26*a* and 26*b*, respectively, and the LEDs 26*a* and 26*b* are caused to go on alternately at a constant cycle (at an appointed interval).

Light irradiated from the LEDs 26*a* and 26*b* is focused at a lens at the calculating portion 31 side, and thereafter is received by the position detecting sensor 29 which is provided alone for both the two LEDs 26*a* and 26*b*.

In the position detecting sensor 29, an electric charge is induced with respect to the light receiving quantity, and the corresponding electric charge is outputted from electrodes secured in the respective directions (for example, where the light receiving plane is the horizontal plane consisting of two axes X and Y, +X direction, −X direction, +Y direction and −Y direction) via a uniform resistance layer as an optic current. At this time, utilizing a change in size of the optic current outputted from the respective electrodes depending upon the light receiving positions, it is possible to calculate the coordinate value data of the light receiving position. The light spot position calculating portion 33' is to carry out calculations of the coordinate value data.

However, although light is irradiated from both the LEDs 26*a* and 26*b* to the position detecting sensor 29, it is not discriminated whether the light corresponding to the LED 26*a* is irradiated or the light corresponding to the LED 26*b* is irradiated when calculating the coordinate value data. Therefore, the coordinate value data are discriminated by, for example, causing respective memory elements to hold the coordinate value data.

However, although light is irradiated from both the LEDs 26*a* and 26*b* to the PSD 29, it is not discriminated whether the light corresponding to the LED 26*a* is irradiated or the light corresponding to the LED 26*b* is irradiated when calculating the coordinate value data. Therefore, the coordinate value data are discriminated by, for example, causing respective memory elements to hold the coordinate value data.

That is, by supplying the coordinate value data from the light spot position calculating device 33' to either one of the memory elements 34*a* and 34*b* at different timings corresponding to the blinking signals L1 and L2, the coordinate value data are discriminated.

For this reason, in the transfer apparatus A4 according to the third modified embodiment as shown in FIG. 4, the total sum of optic current outputted from the respective electrodes of the position detecting sensor 29 is utilized. The total sum of optic current outputted from the respective electrodes corresponds to the light quantity received by the position detecting sensor 29. The transfer apparatus A4 of FIG. 4 judges the lighting state of the LEDs 26*a* and 26*b* by the data renewal signal generating portion 40, utilizing the light quantity in order to renew the HOLD content of the memory elements 34*a* and 34*b*.

The total sum outputted from the respective electrodes of the position detecting sensor 29, that is, the light quantity output T, is supplied to the comparator element 41 connected thereafter. An appointed threshold value s is established in the comparator element 41, wherein the comparator element 41 compares the light quantity output T with the appointed threshold value s. If the light quantity output T is greater than the appointed threshold value s, a voltage output corresponding to, for example, N1" is supplied to a further subsequent generating circuit (flip flop) 42, and if the light quantity output T is smaller than the appointed threshold value s, a voltage output corresponding to, for example "0" is supplied to a further subsequent generating circuit (flip flop) 42.

The flip flop 42 detects a rise in the voltage output from the comparator element 41 and reverses the output. That is, once the voltage output from the comparator element 41 rises, for example, the output is reversed from "0" to "1", and if the output rises again, the output is reversed from "1" to "0". Subsequently, this is repeated.

And, the output F of the flip flop 42 is provided into generating circuits (monostable vibrators) 43*a* and 43*b*. On the other hand, the monostable vibrator 43*a* detects a rise of the output F of the flip flop 42 and outputs a pulse for an appointed duration of time while the other monostable vibrator 43*b* detects a drop in the output F of the flip flop 42 and outputs a pulse for an appointed duration of time.

Pulse signals outputted from the two monostable vibrators 43*a* and 43*b* are, respectively, used as the data renewal signals SH1 and SH2 in order to renew the memory elements 34*a* and 34*b*. In the memory elements 34*a* and 34*b*, when the data renewal signals SH1 and SH2 are inputted, the coordinate value data of the light receiving position are acquired from the light spot position calculating portion 33'.

Thereby, the coordinate value data corresponding to the LED 26*a* are held in the memory element 34*a*, and the coordinate value data corresponding to the LED 26*b* are held in the memory element 34*b*. And, in the position posture calculating portion 35', for example, the position in the horizontal direction and rotating angle around the perpendicular axis of the elevating portion 22 with respect to the carriage 21 are calculated from the coordinate value data held in both the memory element 34*a* and memory element 34*b* after an appointed duration of time from a drop of the output F of the flip flop 42.

As shown in, for example, FIG. 7, where, in the horizontal plane consisting of XY, it is assumed that the deviation of the center point Pc between the light receiving position (Xa, Ya) corresponding to the LED 26*a* and the light receiving position (Xb, Yb) corresponding to the LED 26*b* with respect to the optical center of the PSD 29 are Xc, Yc, and an angle constituted by a straight line connecting the two light receiving positions and the X axis or Y axis is θ s, the deviations Xc, Yc and rotating angle θs are calculated in compliance with the calculation equation.

And, the relative position and posture of the elevating portion 22 for the carriage 21, which are calculated by the position posture calculating portion 35', are outputted into a sway controlling portion of the subsequent stage (for example, a sway stop compensating portion 4 of the transfer apparatus A1 as shown in FIG. 1), wherein positioning control and sway stop control of the elevating portion are carried out in the corresponding sway controlling portion.

Thus, in the transfer apparatus A4 according to the third modified embodiment as shown in FIG. 4, the time interval to calculate at least the position of the elevating portion with respect to the carriage is defined on the basis of the lighting state of LEDs, whereby it does not become necessary to provide any electric connections between the carriage and elevating portion, and furthermore, it is possible to easily change the interval of calculation in line with a change in the timing of light emission.

Furthermore, as in the transfer apparatus A4 according to the third modified embodiment as shown in FIG. 4, the transfer apparatuses A2 and A3 (as shown in FIGS. 4 and 10, respectively) detects the lighting state of the LEDs, wherein as a matter of course it is possible to renew the HOLD content of the memory elements 34*a* and 34*b* in accordance with the corresponding detected lighting state.

Furthermore, in the embodiments, although the position in the horizontal direction and rotating angle around the perpendicular axis of the elevating portion with respect to the carriage were obtained, the embodiments are not limited to the above, for example, only the position in the horizontal direction may be obtained, and it is possible to obtain the position in the perpendicular direction, that is, the height of the elevating portion with respect to the carriage. For example, as the relative height of the elevating portion to the carriage changes, the interval between the position to receive light coming from the LED 26*a* and the position to receive light coming from the LED 26*b* in the position detecting sensor 29 may change. Therefore, if the interval is measured with respect to the appointed relative height, it is possible to measure the relative height of the elevating portion with respect to the carriage on the basis of the interval.

Furthermore, although, in each of the embodiments, the coordinate value data corresponding to two LEDs are held in two independent memory elements, this is not limited. For example, the coordinate value data may be classified and held in different areas of the same memory element in compliance with input of the data HOLD signals SH1 and SH2 of different timings.

Still furthermore, although in each of the embodiments, the coordinate value data are discriminated by holding the coordinate value data corresponding to two LEDs in two memory elements, this is not limited. For example, coordinate value data are directly inputted in a register, etc., of a position calculating means while changing over channels by using signals generated at different timings, and the coordinate value data corresponding to the two LEDs are completed, wherein calculation may be commenced.

Furthermore, in each of the embodiments, a position detecting sensor is used as a light receiving position detecting element, but it is not limited to this position detecting sensor. For example, other light receiving elements such as, for example, CCD, etc., may be used. And, the light emitting means is not limited to an LED. For example, other light emitting means such as a semiconductor laser element which oscillates light of a single wavelength in an appointed direction may be used.

Improvement of Sway Stop Control Where a Relative Sway Velocity is Used

In a case where sway control is carried out by using a relative sway portion acquired by a position detecting device as described above, there are cases where signals pertaining to vibration of rails and elastic vibration produced between the positioning actuator and sensors are mixed into signals corresponding to the relative sway position.

Figure 14A:
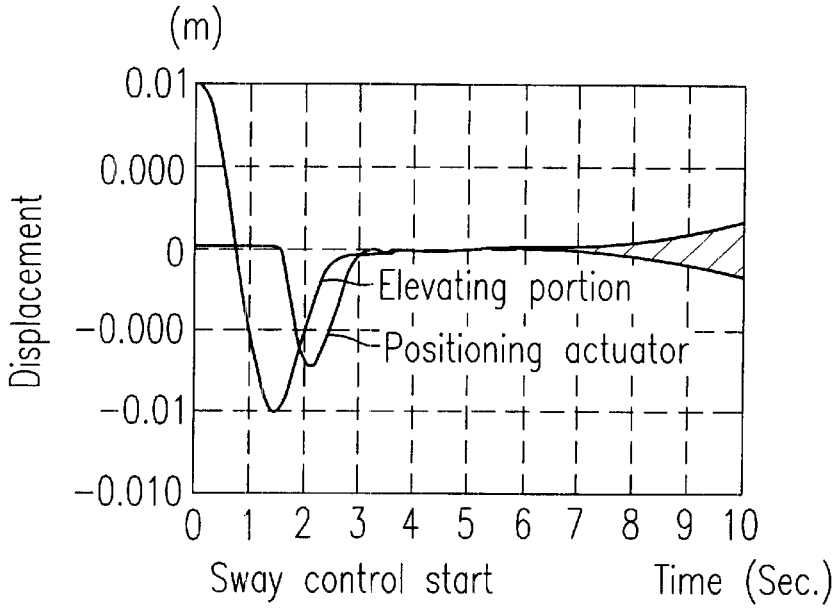
FIGS. 14(*a*) and 14(*b*) are views explaining oscillations resulting from elastic vibration.
Figure 14B:
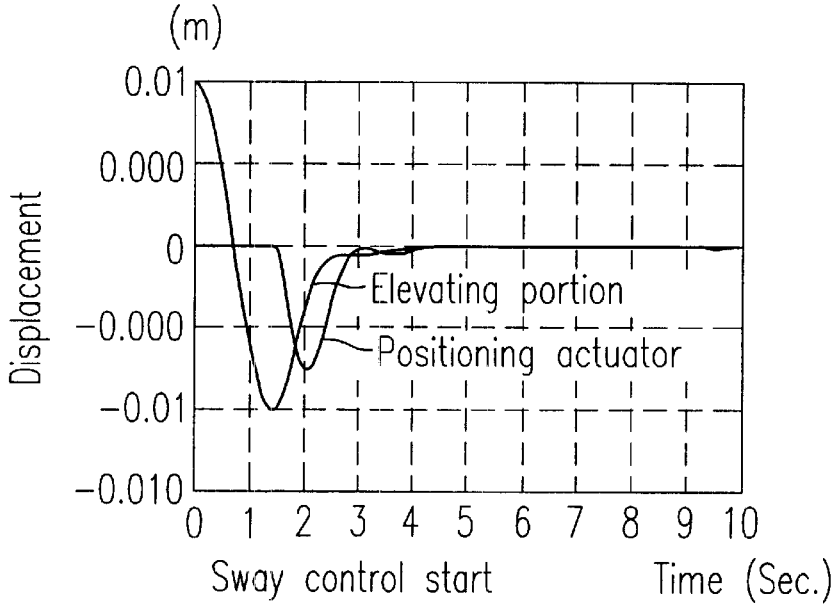

In such a case, if a proportional element 4*a* having a greater value is used in a sway stop compensating portion 4 shown in FIG. 2, in order to attempt to increase a sway control effect, there is a problem by which the proportional element 4*a* is caused to oscillate by a frequency pertaining to the elastic vibration as shown in FIG. 14(*a*).

Furthermore, the frequency pertaining to the elastic vibration may change in compliance with various reasons such as the position of a rail 102 wherein the carriage 103 (FIG. 1) moves, states of the ceiling 101 on which the corresponding rail 102 is disposed, and chronological changes of the respective members, etc.

Figure 15:
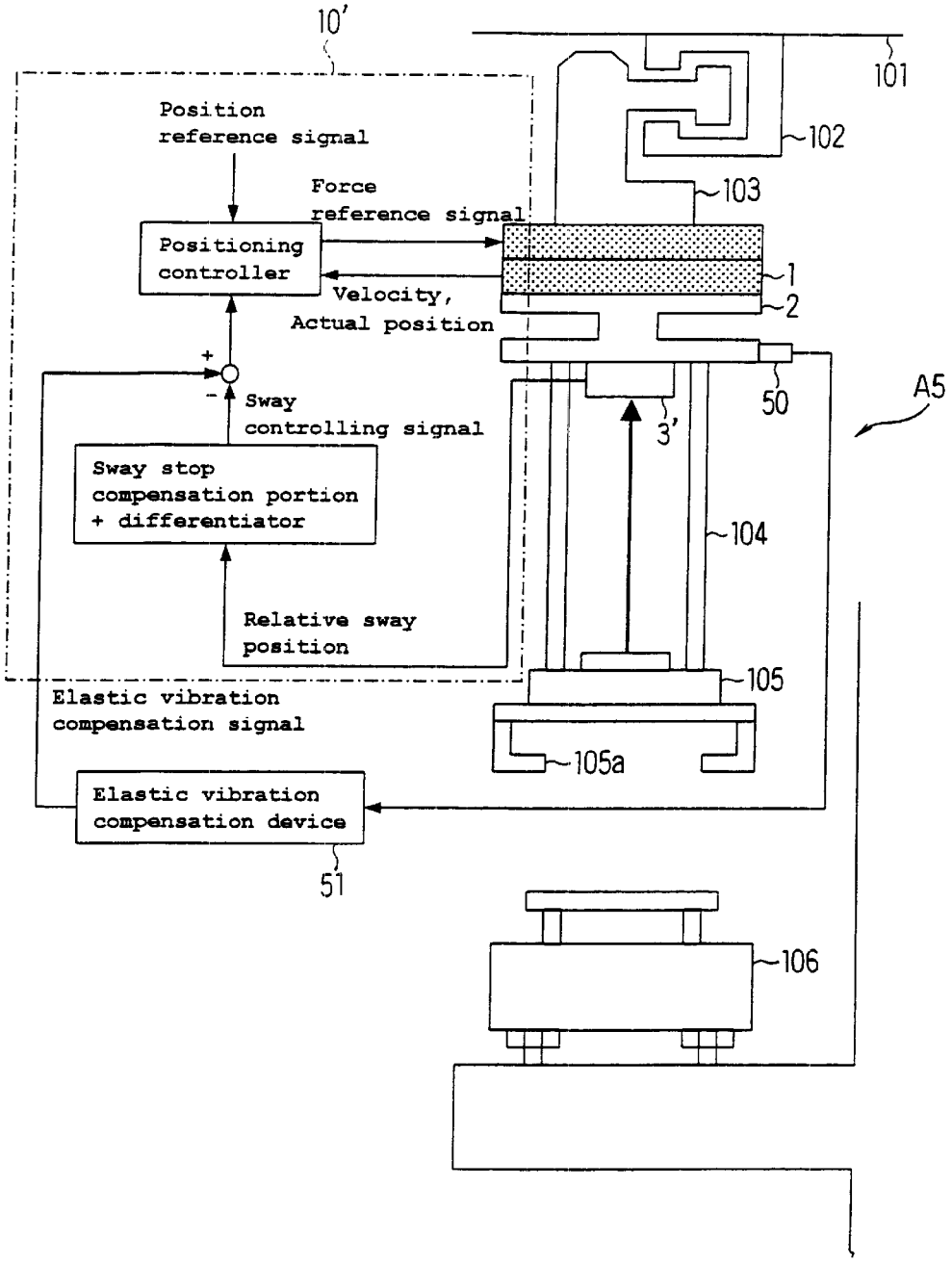
FIG. 15 is an exemplary view showing a simple construction of a transfer apparatus 5 according to a preferred embodiment of the present invention.

Therefore, a description is given of a transfer apparatus A5, as shown in FIG. 15, which preferably suppresses oscillation pertaining to sway control produced by elastic vibrations mixed into signals corresponding to the relative sway velocity, by improving the transfer apparatus A1, as shown in FIG. 1.

The transfer apparatus A5, as shown in FIG. 15, is provided with: a carriage 103 moving along a rail 102 disposed on the ceiling 101; a positioning actuator 1 and an upper plate 2, which are attached to the lower part of the carriage 103; a suspension member 104 suspended from the upper plate 2; an elevating portion 105 which is attached to the lower end portion of the suspension member 104 and has a hand 105*a*, capable of holding a load 106, attached integral therewith; an optical type position sensor 3' for detecting the relative sway position with respect to the upper plate 2 of the elevating portion 105; and an elevating portion position controlling device 10' which actuates the positioning actuator 1 by controlling the position and velocity of the positioning actuator 1 while controlling sway of the elevating portion 105 on the basis of the relative position with respect to the upper plate 2 of the elevating portion 105 and which controls the position of the elevating portion 105.

The transfer apparatus A5, as shown in FIG. 15, differs from the transfer apparatus A1, as shown in FIG. 1, especially in that the transfer apparatus A5, as shown in FIG. 15, is provided with an acceleration sensor 50 (corresponding to the elastic vibration component detecting means) attached to the upper plate 2 in order to detect elastic vibration components mixed into signals corresponding to the elastic vibration velocity of the elevating portion 105, and a elastic vibration compensating portion 51 (corresponding to the excluding means and elastic vibration component compensating portion) to compensate the elastic vibration components on the basis of acceleration signals of the elastic vibration components of the upper plate 2 detected by the acceleration sensor 50.

Next, a detailed description is given of the transfer apparatus A5, as shown in FIG. 15. Herein, FIG. 16 is one example of control block diagrams of the transfer apparatus A5, as shown in FIG. 15.

Figure 16:
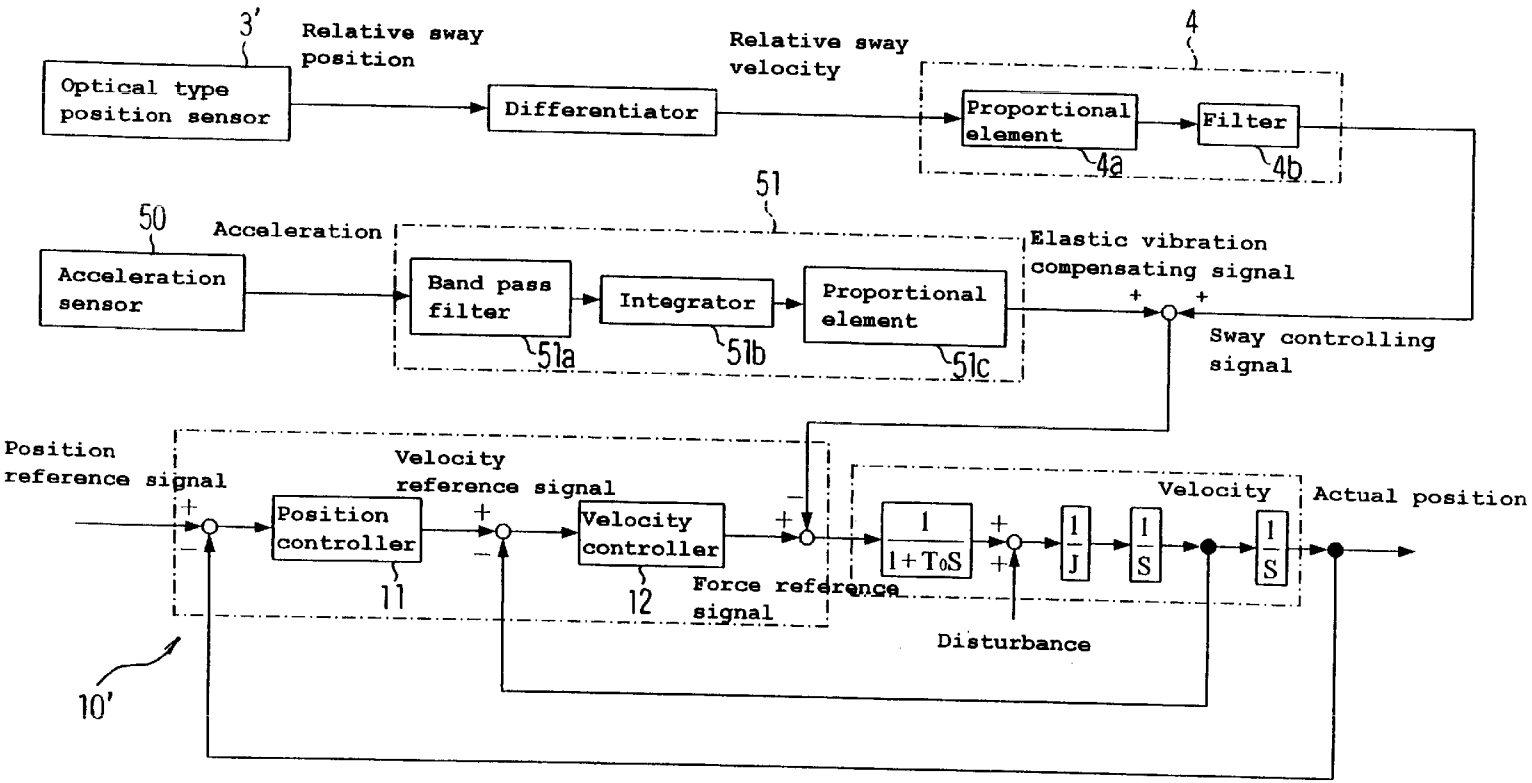
FIG. 16 is a block diagram showing a simple construction of an elevating portion position controlling device 10 pertaining to the transfer apparatus A5.

As shown in FIG. 16, the elevating portion position controlling device 10' is provided with: a position control loop which outputs a velocity reference signal by a position controller 11 on the basis of deviations between the position reference signal for the positioning actuator 1 and its actual position; a velocity control loop which outputs a force reference signal to the positioning actuator 1 by the velocity controller 12 on the basis of deviations between the velocity reference signal outputted from the position controller 11 for the positioning actuator 1 and its actual velocity; a sway stop compensating portion 4 including a proportion element 4*a* and a filter 46, which outputs a sway control signal to the positioning actuator 1 in compliance with the relative sway velocity of the elevating portion 105, which is defined on the basis of the relative sway position of the elevating portion 105, which is detected by the optical type position sensor 3'; and a elastic vibration compensating portion 51 consisting of a band pass filter 51*a* to exclude noise components from the acceleration signals of elastic vibration components detected by the acceleration sensor 50 and a phase compensating portion 51*b* to compensate the phase between the relative sway velocity of the elevating portion 105 and the elastic vibration components.

Furthermore, the proportional element 4*a* is established in compliance with a stop height of the elevating portion 105, and the filter 4*b* is a low pass filter provided in order to prevent a servo system from oscillating due to observation noise by eliminating the observation noise.

Subsequently, a description is given of control actions of the positioning actuator 1, which are performed by the elevating portion position controlling device 10'.

As the carriage 103 stops at a station, a position reference signal is issued to the elevating portion position controlling device 10', by which the positioning actuator 1 is controlled to, for example, an appointed reference position (which is determined by a relative position between the carriage 103 and the upper plate 2). The position reference signal is inputted into the position controller 11 after acquiring a deviation from the actual position of the positioning actuator 1. And, a velocity reference signal, by which the position deviation is made zero, is outputted from the position controller 11, wherein the velocity reference signal is further inputted into the velocity controller 12, acquiring a deviation from the actual velocity of the positioning actuator 1. Furthermore, a force reference signal, by which the velocity deviation is made zero, is outputted from the velocity controller 12.

Furthermore, at the same time, the relative sway velocity which is acquired by differentiating the relative sway position of the elevating portion 105 outputted from the optical type position sensor 3', by a differentiator, is inputted into the sway stop compensating portion 4.

In the sway stop compensating portion 4, the proportional element 4*a* outputs a thrust in compliance with the relative sway velocity of the elevating portion 105, and is outputted as a sway control signal via the filter 4*b*.

The sway control signal outputted from the sway stop compensating portion 4 is added to a force reference signal outputted from the velocity controller 12 after being phase-reversed, and the force reference signal is inputted into the positioning actuator 1, wherein an appointed action is carried out.

With the control, if there is sway at the elevating portion 105, the positioning actuator 1 is equivalently displaced in proportion to the sway velocity of the elevating portion 105. Herein, as a position deviation between the upper plate 2 and the elevating portion 105 is produced, a force proportional thereto operates onto the elevating portion 105. Therefore, a force proportional to the sway velocity of the elevating portion 105 is given to the elevating portion as an attenuation force. Therefore, the sway of the elevating portion 105 can be suppressed in a short time.

However, as a elastic vibration occurs on the upper plate 2 intervening, for example, between the positioning actuator 1 and the optical type position sensor 3', the elastic vibration components will adversely influence upon the relative sway velocity of the elevating portion 105, the base of which is placed on the upper plate 2, wherein in the sway control described above, there is a case where oscillation may occur due to elastic vibration components. In particular, if the value of the proportional element 4*a* is great, this tendency is increased.

Therefore, in the transfer apparatus A5 as shown in FIG. 15, by performing velocity feedback including elastic vibration components by adding the elastic vibration compensating signals to compensate the elastic vibration to the sway controlling signals, the oscillation pertaining to the sway control, resulting from the elastic vibration components, can be suppressed.

The acceleration sensor 50 and elastic vibration compensating portion 51 are provided in the elevating portion position controlling device 10' for this reason.

The acceleration sensor 50 is attached to, for example, the upper plate 2 and measures acceleration signals of the elastic vibration components at the upper plate 2. Furthermore, it is necessary that the acceleration sensor 50 is provided at places where elastic vibration components are produced or seem to be produced, in a case where elastic vibration is produced at, for example, the rail 102, it is necessary to provide a means equivalent to the acceleration sensor 50 at the rail 102.

The elastic vibration compensating signals are generated by the elastic vibration compensating portion 51 on the basis of the acceleration signals of the elastic vibration components.

The elastic vibration compensating portion 51 consists of a band pass filter 51*a*, a phase compensating portion 51*b*, and proportional element 51*c*. Furthermore, the elastic vibration compensating portion 51 may be achieved by one compensating portion having combined characteristics of these three factors.

Figure 17:
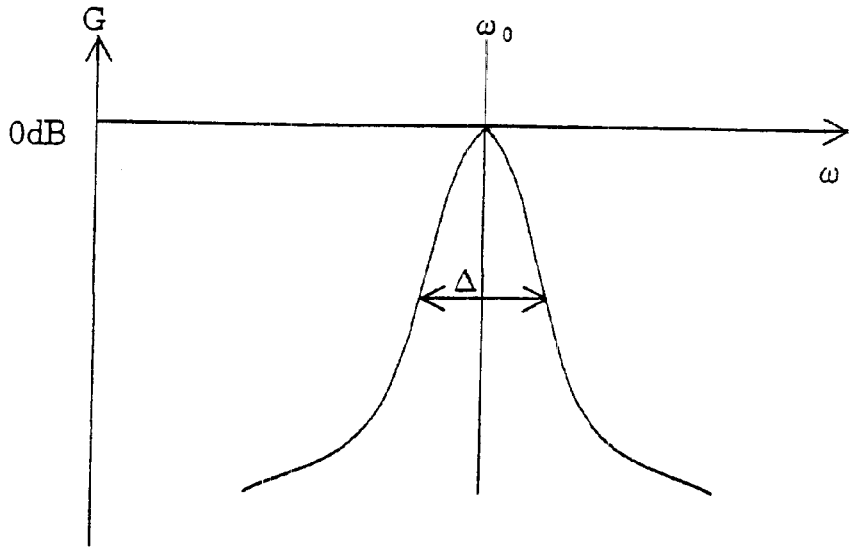
FIG. 17 is a view showing a gain curve of a band pass filter.

The band pass filter 51*a* may be accomplished by a digital filter using, for example, a DSP, etc., and the transmission function of the frequency is expressed by the following:

$$G(s)=2\zeta\omega_0\, s/(s^2+2\zeta\omega_0\, s+\omega_0^2)$$

where $\omega_0$ is the center frequency of the band pass filter and $\zeta$ is a constant. FIG. 17 shows a gain curve of the band pass filter. Furthermore, the abscissa is a linear axis of the frequency $\omega$, and the ordinate is a logarithm axis of the gain G.

As shown in FIG. 17, the band pass filter 51*a* is to suppress signals by eliminating components in the vicinity of the center frequency $\omega_0$. It is possible to modify the frequency width $\Delta$, in which signals are permitted to pass through, in compliance with setting of the constant $\zeta$. By this band pass filter 51*a*, noise components can be eliminated from the acceleration signals of the elastic vibration components. The center frequency $\omega_0$ and constant $\zeta$ of the band pass filter 51*a* are established in advance in compliance with the acceleration signals of the elastic vibration components and characteristics of the noise components. If the band pass filter 51*a* is composed of a digital filter, it is very easy to modify setting of the center frequency $\omega_0$ and constant $\zeta$.

A phase between the sway velocity of the elevating portion 105 and the elastic vibration components are compensated by a phase compensating portion 51*b* composed of an integrator, etc., with respect to the acceleration signals of elastic vibration components from which noise components are eliminated by the band pass filter 51*a*.

And, elastic vibration compensating signals are outputted from the elastic vibration compensating portion 51 via the proportional element 51*c*, the value of which is established in compliance with the elastic vibrations produced at the upper plate 2 and is added to the sway control signals.

Thereby, velocity feedback including the elastic vibration components will be carried out, and even in a case where elastic vibration is produced at the upper plate 2, etc., oscillations pertaining to the sway control resulting from the elastic vibration components can be suppressed as shown in FIG. 14(*b*).

Thus, according to the transfer apparatus A5 as shown in FIG. 15, even in a case where elastic vibration components are mixed into signals corresponding to the sway velocity of the elevating portion by generation, etc., of elastic vibrations, for example, at the upper plate, elastic vibration compensating signals generated on the basis of the elastic vibration components are added to the sway controlling signals, whereby the elastic vibration components are compensated and oscillation pertaining to the sway control can be effectively suppressed.

Modified Embodiment of the Transfer Apparatus A5

Figure 18:
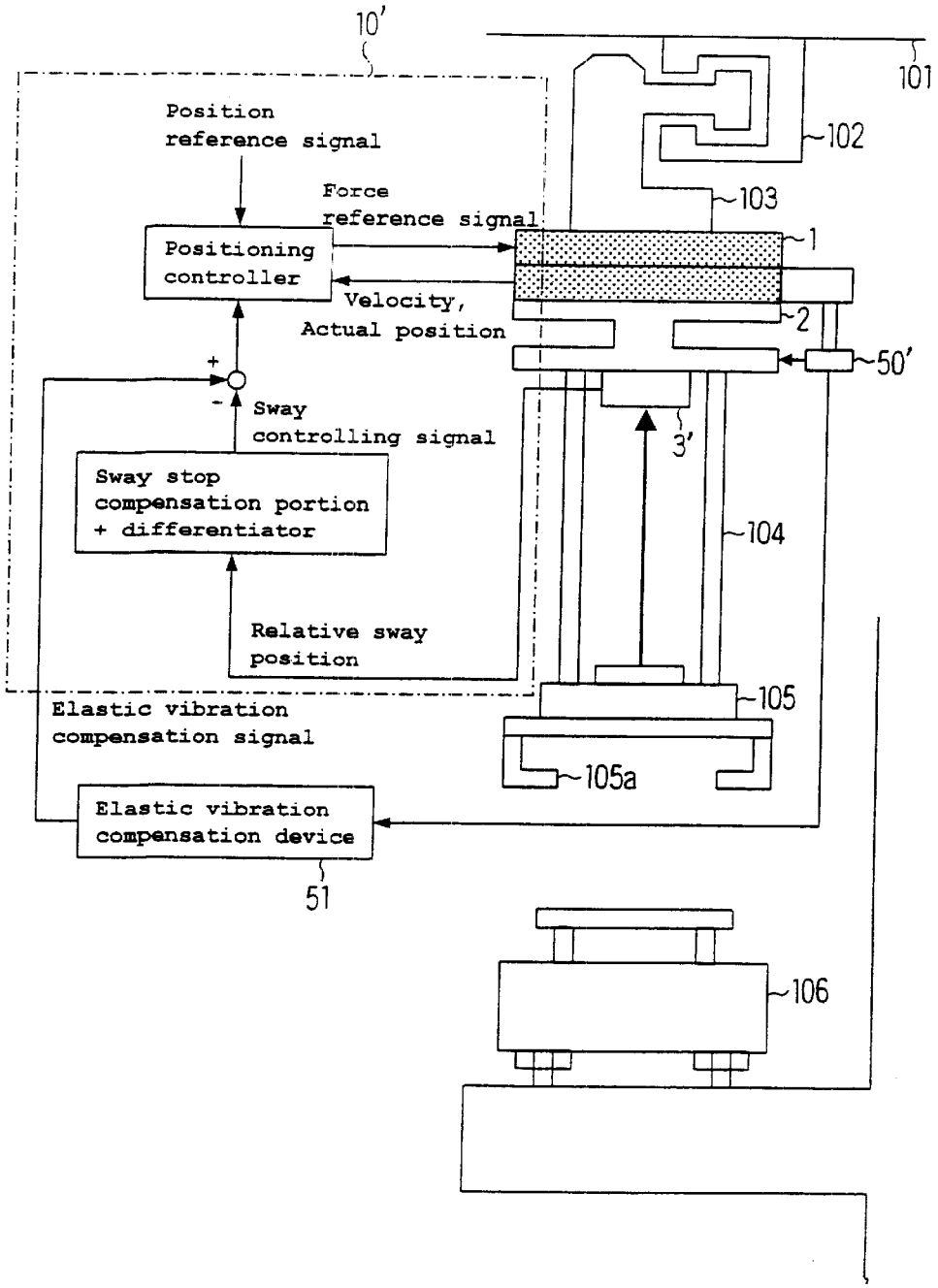
FIG. 18 is a view showing a simple construction in a case where a position sensor 50 of the transfer apparatus A5 is replaced by a position sensor 50' which detects a positional deviation between a positioning actuator 1 and an upper plate 2.

Although the transfer apparatus A5, as shown in FIG. 15, detects an acceleration signal of elastic vibration components at the upper plate 2 by the acceleration sensor 50, the apparatus is not limited to this. As shown in FIG. 18, a position sensor 50' which detects a positional deviation between the positioning actuator 1 and the upper plate 2, signals corresponding to the acceleration signals of the elastic vibration components may be defined by the position of the upper plate 2, which is detected by the position sensor 50'. Furthermore, although not being illustrated, a velocity sensor is provided at the upper plate 2, and signals corresponding to the acceleration signals of the elastic vibration components may be defined by a velocity of the upper plate 2, which is detected by the velocity sensor.

Figure 19:
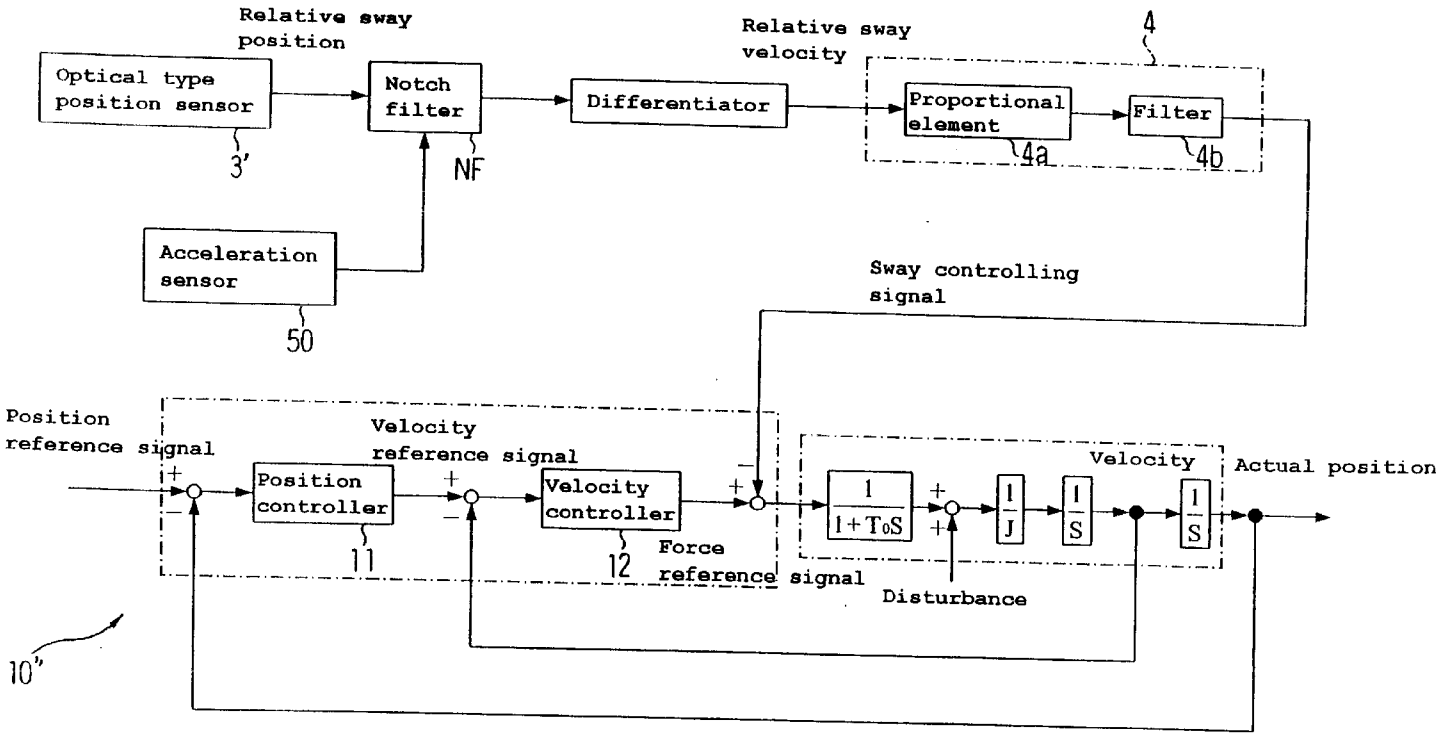
FIG. 19 is a block diagram showing a simple construction of an elevating portion position controlling device 10" according to a modified embodiment of the transfer apparatus A5.

Furthermore, as shown in FIG. 19, a notch filter NF, which is able to suppress only the elastic vibration components based on the output signals from the acceleration sensor 50 and those corresponding to the relative sway velocity of the elevating portion 105, which come from the optical type position sensor 3', is disposed before the sway stop compensating portion 4, thereby acquiring oscillation preventing effects similar thereto.

That is, the relative sway velocity which is acquired by differentiating the relative sway position of the elevating portion 105, outputted from, for example, the optical type position sensor 3', by a differentiator, is inputted into the sway stop compensating portion 4. Only the elastic vibration components mixed into the relative sway position and produced at the upper plate 2 and rail 102, etc., are suppressed by the notch filter. The notch filter NF may be also accomplished by a digital filter using, for example, DSP, etc., wherein the transmission function of the frequency is expressed by the following expression:

$$G(s)=s^2+\omega_0^2/(s^2+2\zeta\omega_0 s+\omega_0^2)$$

Figure 20:
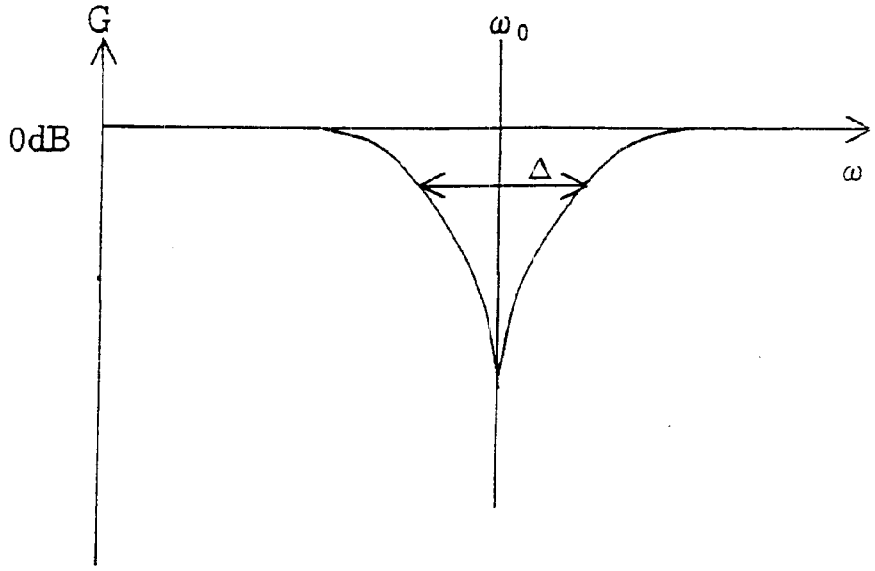
FIG. 20 is a view showing a gain curve of a notch filter.

(where $\omega_0$ is the center frequency of the notch filter NF and $\zeta$ is a constant. FIG. 20 shows a gain curve of the notch filter NF. Furthermore, the abscissa is a linear axis of the frequency $\omega$, and the ordinate is a logarithm axis of the gain G.

As shown in FIG. 20, the notch filter NF is to suppress only the components in the vicinity of the center frequency $\omega_0$. The center frequency $\omega_0$ is established to a frequency of the elastic vibration components measured in advance. Furthermore, if the constant $\zeta$ is set to be great, the frequency width $\Delta$, which suppresses signals is widened. If the constant $\zeta$ is set to be small, the frequency width $\Delta$ is narrowed.

The center frequency $\omega_c$ and the frequency width $\Delta$ of the notch filter NF are adjusted on the basis of the acceleration signals of elastic vibration components produced at the upper plate 2, which are detected by the acceleration sensor 50.

Thereby, even in a case where the characteristic of the elastic vibration components is changed, it is possible to effectively suppress only the elastic vibration components on the basis of the relative sway velocity of the elevating portion 105, and to suppress the oscillation applied to the sway control resulting from the elastic vibration components. Furthermore, where the notch filter NF is constructed of a digital filter, it is easy to modify the center frequency $\omega_0$ and constant $\zeta$. However, as a matter of course, it is possible to construct the band pass filter 51*a* and notch filter NF of an analog filter.

Others

In each of the embodiments, a description was given of the case where the sway direction of the elevating portion 105 is limited to the direction orthogonal to the rail. However, as regards a sway parallel to the rail and sway in the twisting direction of the suspension member 104, control similar to the above may be carried out by using a positioning actuator movable in the direction parallel to the rail and around the perpendicular axis.

Furthermore, the carriage 103 itself may be used as a positioning means. That is, the sway stop and positioning of the elevating portion 105 may be executed by movement of the carriage 103 on the rail 102. However, in this case, only the sway components parallel to the rail may be treated.

Furthermore, in the embodiments, although the sway controlling signals generated in the sway stop compensating portion 4 are added to the force reference signal outputted from the velocity controller 12, the embodiments are not limited to this. The sway controlling signals may be added to, for example, a velocity reference signal inputted into the velocity controller 12, and a position reference signal inputted into the position controller 11. As a matter of course, if the addition position of the sway control signals is changed, it is necessary to establish the proportional element 4*a* in compliance therewith.

As described above, the invention provides a suspension type hoisting apparatus which is able to adjust the position of the elevating portion elevatably suspended from the base via a suspension member by an elevating portion position controlling device including a positioning means for positioning the suspension member suspended from the base in the horizontal plane; a position controller for outputting a velocity reference signal on the basis of a deviation between a position reference signal for the positioning means and the actual position thereof; and a velocity controller for outputting a force reference signal being a manipulated variable of the positioning means on the basis of a deviation between the velocity reference signal, outputted from the position controller, for the positioning means, and the actual velocity thereof; wherein the elevating portion position controlling device further comprises a sway velocity detecting means for detecting a sway velocity of the elevating portion; a sway stop compensating portion for outputting a sway controlling signal for the positioning means on the basis of output from the sway velocity detecting means; and an adder portion for adding the sway controlling signal outputted from the sway stop compensating portion to the force reference signal outputted from the velocity controller. Therefore, it is possible to effectively stop sway of the elevating portion and to position the same by a simple control system, and it is possible to remarkably improve working efficiency.

Furthermore, in a case where the sway velocity detecting means is constructed so that relative sway velocitys with respect to the base of the elevating portion is detected, since the sway velocity detecting means is further provided with a elastic vibration component detecting means for detecting elastic vibration components produced at the base; and an excluding means for excluding influences due to the elastic vibration components from sway control made by the sway stop compensating portion on the basis of the elastic vibration components detected by the elastic vibration component detecting means, it is possible to prevent the sway control from oscillation resulting from the elastic vibration components produced at the base.

Furthermore, the sway velocity detecting means for detecting a relative sway velocity of the elevating portion with respect to the base is provided with a light emitting means installed on the base or the elevating portion; a lens installed opposite to the light emitting means on the elevating portion or the base in order to focus light coming from the light emitting means; and a light receiving position detecting element, installed on the elevating portion or the base, which receives the light focused by the lens and detects the light receiving position, and is constructed so that the relative positions of the elevating portion with respect to the base are detected one after another on the basis of the light receiving position detected by the light receiving position detecting element, and at the same time the relative velocity of the elevating portion is detected on the basis of the detected relative position of the elevating portion, wherein since at least two light emitting means are provided, and a calculating means is provided, which calculates a position of the elevating portion in the horizontal direction, a position of the elevating portion in the perpendicular direction and a rotating angle around the perpendicular axis with respect to the base on the basis of the detection results of the light receiving position detecting element with respect to the respective light by alternate blinking of the respective light emitting means, it is possible to accurately detect the position at a high velocity with a simple construction not requiring any image processing, etc.

Furthermore, if the plurality of light emitting means are provided in a plurality with the installation interval thereof changed and one set of the plurality of sets of light emitting means is selectively used in compliance with the elevation length of the elevating portion, it is possible to prevent the detection range from being reduced, as much as possible, in a case where the base is close to the elevating portion and a lowering of the detection accuracy in a case where the base is far from the elevating portion.

Furthermore, if it is constructed that a lighting state detecting means for detecting the lighting state of the light emitting means on the basis of the quantity of light received by the light receiving position detecting element is provided, and the detection results of the light receiving position detecting element is acquired by the calculating means on the basis of the lighting state, of the light emitting means, detected by the lighting state detecting means, there is no need for electric wiring between the base and the elevating portion, and moreover even though the lighting timing of the light emitting means is changed, it is not necessary to change the acquisition timing of the light receiving position in line therewith.

Furthermore, if the sway velocity detecting means is further provided with a memory element for temporarily storing the light receiving position detected by the light receiving position detecting element, the memory element is renewed on the basis of the lighting state, of the light emitting means, detected by the lighting state detecting means, the calculating means carries out the calculation once for each appointed interval of time on the basis of the light receiving position temporarily held in the memory element, the calculating means is able to acquire the light receiving position from the memory element at an interval suited to the light emission timing of the light emitting means without requiring any electric wiring between the base and the elevating portion.

Furthermore, a variable stop means is provided, which varies the quantity of light incident into the light receiving position detecting element, and a stop controlling portion is provided, which controls the variable stop means in compliance with the elevation length of the elevating portion, wherein even though the distance between the elevating portion and the base is decreased, it is possible to suppress a light spot on the light receiving position detecting element from being enlarged, by controlling so as to reduce the opening diameter of the variable stop means in line with an increase in height of the position of, for example, the elevating portion, and it is possible to further prevent the detection range from being reduced. Furthermore, in addition thereto, the fluctuations of the light quantity of the light receiving position detecting element can be reduced even in a long or short distance, whereby such an effect can be obtained, by which the position detecting accuracy is improved.

What is claimed is:

1. A hoisting apparatus for adjusting a position of an elevating portion, elevatably suspended from a base, via a suspension member using an elevating portion position controlling device including a positioning means structurally configured to position said suspension member, which is suspended from said base in a horizontal plane, a position controller for outputting a signal related to velocity based upon a deviation between a signal related to a position of said positioning means and an actual position of said positioning means, and a velocity controller for outputting a signal related to force, being a manipulated variable of said positioning means, based upon a deviation between said signal related to velocity outputted from said position controller for said positioning means and an actual velocity of said positioning means, said elevating portion position controlling device comprising:

a sway velocity detecting means for detecting a sway velocity of said elevating portion;

a sway stop compensating portion for outputting a sway controlling signal for said positioning means based upon output from said sway velocity detecting means;

an adder portion for adding said sway controlling signal outputted from said sway stop compensating portion to an appointed signal on a control loop of said elevating portion position controlling device;

wherein said base is a carriage moving along a rail;

wherein said positioning means is structurally configured to position said suspension member, suspended from said carriage, in a direction parallel to said rail, in a direction perpendicular to said rail, and around a perpendicular axis; and wherein said sway velocity detecting means is to detect a relative sway velocity of said elevating portion with respect to said base, said sway velocity detecting means includes an elastic vibration component detecting means for detecting elastic vibration components produced at said base and an excluding means for excluding influences due to said elastic vibration components from sway control made by said sway stop compensating portion based upon said elastic vibration components detected by said elastic vibration component detecting means.

2. The hoisting apparatus as set forth in claim 1, wherein said excluding means excludes influences due to said elastic vibration components from said sway control by adding elastic vibration compensating signals generated based upon said elastic vibration components detected by said elastic vibration component detecting means to said sway controlling signals outputted from said sway stop compensating portion.

3. The hoisting apparatus as set forth in claim 2, wherein said elastic vibration compensating signal is generated by an elastic vibration component compensating portion including a band pass filter to exclude noise components contained in said elastic vibration components detected by said elastic vibration component detecting means, and a phase compensating portion for compensating a phase between a relative sway velocity of said elevating portion and said elastic vibration components.

4. The hoisting apparatus as set forth in claim 1, wherein said excluding means is a notch filter for suppressing said elastic vibration components from signals corresponding to said sway velocity of said elevating portion, said notch filter suppressing a frequency band by said notch filter, which is adjusted based upon elastic vibration component detected by said elastic vibration component detecting means.

5. The hoisting apparatus as set forth in claim 1, wherein said elastic vibration component detecting means detects signals corresponding to acceleration signals of said elastic vibration components.

6. A hoisting apparatus for adjusting a position of an elevating portion, elevatably suspended from a base, via a suspension member using an elevating portion position controlling device including a positioning means structurally configured to position said suspension member, which is suspended from said base in a horizontal plane, a position controller for outputting a signal related to velocity based upon a deviation between a signal related to a position for said positioning means and an actual position of said positioning means, and a velocity controller for outputting a signal related to force, being a manipulated variable of said positioning means, based upon a deviation between said signal related to velocity outputted from said position controller for said positioning means and an actual velocity of said positioning means, said elevating portion position controlling device comprising:

a sway velocity detecting means for detecting a sway velocity of said elevating portion;

a sway stop compensating portion for outputting a sway controlling signal for said positioning means based upon output from said sway velocity detecting means;

an adder portion for adding said sway controlling signal outputted from said sway stop compensating portion to an appointed signal on a control loop of said elevating portion position controlling device;

wherein said base is a carriage moving along a rail;

wherein said positioning means is structurally configured to position said suspension member, suspended from said carriage, in a direction parallel to said rail, in a direction perpendicular to said rail, and around a perpendicular axis; and wherein said sway velocity detecting means comprises:

a light emitting means installed on any one of said base and said elevating portion;

a lens installed on any one of said elevating portion and said base opposite to said light emitting means, which focuses light coming from said light emitting means; and a light receiving position detecting element installed on any one of said elevating portion and said base, which detects a light receiving position by receiving light focused by said lens;

wherein said sway velocity detecting means detects relative positions of said elevating portion with respect to said base one after another based upon said light receiving position detected by said light receiving position detecting element, and at a same time detects relative velocities of said elevating portions based upon a detected relative position of said elevating portion.

7. The hoisting apparatus as set forth in claim 6, wherein at least two light emitting means are provided and a calculating means is provided, said calculating means calculating a position of said elevating portion in a horizontal direction, a position of said elevating portion in a perpendicular direction and a rotating angle around a perpendicular axis with respect to said base based upon detection results of said light receiving position detecting element with respect to said light by alternate blinking of said at least two light emitting means.

8. The hoisting apparatus as set forth in claim 7, wherein said at least two light emitting means are provided in a plurality of sets with an installation interval of said at least two light emitting means changed, and a set of said plurality of sets of light emitting means is selectively used in compliance with an elevation length of said elevating portion.

9. The hoisting apparatus as set forth in claim 8, further comprising a lighting state detecting means which detects a lighting state of said light emitting means based upon a quantity of light received by said light receiving position detecting element, wherein said calculating means acquires detection results of said light receiving position detecting element based upon said lighting state, of said light emitting means, detected by said lighting state detecting means.

10. The hoisting apparatus as set forth in claim 9, wherein said sway velocity detecting means is further provided with a memory element for temporarily holding said light receiving position detected by said light receiving position detected by said light receiving position detecting element, said memory element being renewed based upon said lighting state, of said light emitting means, detected by said lighting state detecting means and said calculating means carries out a calculation once for each appointed interval of time based upon said light receiving position temporarily held in said memory element.

11. The hoisting apparatus as set forth in claim 6, further comprising a variable stop means for varying a quantity of said light incident into said light receiving position detecting element, and a stop controlling portion for controlling said variable stop means in compliance with an elevation length of said elevating portion.

* * * * *